US007772512B2

(12) United States Patent
Milo

(10) Patent No.: US 7,772,512 B2
(45) **Date of Patent: *Aug. 10, 2010**

(54) PUSH PLATE ASSEMBLY

(75) Inventor: Thomas K. Milo, Akron, OH (US)

(73) Assignee: T.K.M. Unlimited, Inc., Akron, OH (US)

( * ) Notice: Subject to any disclaimer, the term of this patent is extended or adjusted under 35 U.S.C. 154(b) by 1145 days.

This patent is subject to a terminal disclaimer.

(21) Appl. No.: 11/098,282

(22) Filed: Apr. 4, 2005

(65) Prior Publication Data

US 2005/0224329 A1 Oct. 13, 2005

Related U.S. Application Data

(60) Provisional application No. 60/560,178, filed on Apr. 7, 2004, provisional application No. 60/572,070, filed on May 18, 2004, provisional application No. 60/589,124, filed on Jul. 19, 2004.

(51) Int. Cl.
*H01H 13/14* (2006.01)

(52) U.S. Cl. ..... 200/341; 200/345; 318/466; 340/573.7

(58) Field of Classification Search ..... 200/341–345, 200/329, 296, 520; 318/280, 283, 466, 468; 340/573.1, 573.7, 568.1, 541
See application file for complete search history.

(56) References Cited

U.S. PATENT DOCUMENTS

| | | | |
|---|---|---|---|
| 2,794,890 | A | 6/1957 | Taylor |
| 3,233,071 | A | 2/1966 | Buzzell |
| 3,365,156 | A | 1/1968 | Beck |
| 3,912,216 | A | 10/1975 | Gano |
| 4,132,380 | A | 1/1979 | Pastore |
| 4,350,857 | A | 9/1982 | Fillus et al. |
| 4,389,550 | A | 6/1983 | Reiter |
| 4,524,938 | A | 6/1985 | Strahs et al. |
| 4,613,135 | A | 9/1986 | Rush |

(Continued)

FOREIGN PATENT DOCUMENTS

| | | |
|---|---|---|
| JP | 04-14717 | 1/1992 |

OTHER PUBLICATIONS

Patent Abstracts of JP 04-14717.

(Continued)

*Primary Examiner*—Kyung Lee
(74) *Attorney, Agent, or Firm*—Fay Sharpe LLP

(57) ABSTRACT

A push plate assembly sends a signal to a receiver. The push plate includes a housing, a push plate, a signal generator, a biasing member, a first latch element, a second latch element, and a button. The push plate is movably mounted to the housing. The signal generator includes a switch. The switch is in electrical communication with circuitry through which a signal is transmitted. The biasing member is disposed between the push plate and the signal generator. The biasing member biases the push plate away from the signal generator. The first latch element is connected to the push plate. The second latch element is disposed in the housing. The first latch element and the second latch element engage with one another to limit the movement of the push plate away from the signal generator as the biasing member acts on the push plate.

36 Claims, 35 Drawing Sheets

U.S. PATENT DOCUMENTS

| | | | | |
|---|---|---|---|---|
| 4,974,798 | A | 12/1990 | Harding et al. | |
| 5,008,505 | A | 4/1991 | Takano et al. | |
| 5,026,016 | A | 6/1991 | Lisowski | |
| 5,035,389 | A | 7/1991 | Wang | |
| 5,059,754 | A | 10/1991 | Kaichi et al. | |
| 5,080,238 | A | 1/1992 | Hochman | |
| 5,129,613 | A | 7/1992 | Lloyd et al. | |
| 5,152,487 | A | 10/1992 | Defatte et al. | |
| 5,356,104 | A | 10/1994 | Rosenberg et al. | |
| 5,391,848 | A | 2/1995 | Murphy | |
| 5,510,587 | A | 4/1996 | Reiter | |
| 5,667,059 | A | 9/1997 | Lee | |
| 5,707,033 | A | 1/1998 | Holt et al. | |
| 5,819,913 | A | 10/1998 | Reiter | |
| 5,898,141 | A | 4/1999 | Blalock et al. | |
| 5,941,372 | A | 8/1999 | Johnston | |
| 5,954,191 | A | 9/1999 | Reiter | |
| 6,119,878 | A | 9/2000 | Zen | |
| 6,282,931 | B1 * | 9/2001 | Padiak et al. | 70/279.1 |
| 6,580,355 | B1 * | 6/2003 | Milo | 340/5.7 |
| 6,608,253 | B1 * | 8/2003 | Rintz | 174/66 |
| 6,703,571 | B2 | 3/2004 | Nishimoto et al. | |
| 6,967,580 | B1 * | 11/2005 | Schulze | 340/573.7 |
| 7,010,947 | B2 * | 3/2006 | Milo | 70/257 |
| 7,038,409 | B1 * | 5/2006 | Mullet | 318/280 |
| 7,098,411 | B1 * | 8/2006 | McConnell et al. | 200/5 R |
| 2003/0214384 | A1 * | 11/2003 | Milo | 340/5.7 |
| 2003/0234169 | A1 | 12/2003 | Iwakiri | |
| 2006/0267566 | A1 * | 11/2006 | Williams et al. | 323/282 |

OTHER PUBLICATIONS

Brochure—Stainless Steel BEA 4¾" Square Style Push Plates (2 pages).
Brochure—Stainless Steel 4½" Square Removable Face Plate Push Plates (2 pages).
Brochure—Touchless Microwave Push Plates (2 pages).
Brochure—Touch Membrane Push Plates (2 pages).
Brochure—Accessories for Automatic Doors (2 pages).
Brochure—The Push Plates for Automatic Doors (2 pages).
Brochure—Users Guide Stainless Steel Pushplates (15 pages).
Brochure—Users Guide Transmitter and Receiver (10 pages).

* cited by examiner 414
412
512
526
466
476
466
512

412
414
444
466
512
466

466
476
510
512
514
418
466
438
466
514
512
510
498
412
466

526
510
512
514
418
476
466
464
496
438
414
512
494
412

526
444
414
444
410
412
444
444

PUSH PLATE ASSEMBLY

This application claims the benefit of U.S. Provisional Patent Application Ser. No. 60/560,178, filed Apr. 7, 2004; Ser. No. 60/572,070, filed May 18, 2004; and Ser. No. 60/589,124, filed Jul. 19, 2004, each of which is incorporated by reference herein.

BACKGROUND OF THE INVENTION

The invention relates assemblies to send a signal to a receiver. More particularly, the assembly relates to a push plate assembly to deliver a signal to a receiver in a device that actuates a door opener. Nevertheless, the assembly can be used in other environments to send signals to receivers. In these other environments, the assembly can also send signals other than a signal simply open door.

SUMMARY OF THE INVENTION

A push plate assembly sends a signal to a receiver. The push plate includes a housing, a push plate, a signal generator, a biasing member, a first latch element, a second latch element, and a button. The push plate is movably mounted to the housing. The signal generator includes a switch. The switch is in electrical communication with circuitry through which a signal is transmitted. The biasing member is disposed between the push plate and the signal generator. The biasing member biases the push plate away from the signal generator.

The first latch element is connected to the push plate. The second latch element is disposed in the housing. The first latch element and the second latch element engage with one another to limit the movement of the push plate away from the signal generator as the biasing member acts on the push plate. At least one of the first latch element and the second latch element is accessible from outside of the housing by an associated hand tool such that the hand tool can contact at least one of the first latch element and the second latch element to disengage the first latch element from the second latch element so that the push plate can be selectively removed from the housing. The button is interposed between the push plate and the signal generator. The button is disposed in relation to the push plate and the switch so that when a force is applied to the push plate moving the push plate towards the signal generator, the push plate contacts the at least one button to activate the switch.

A push plate assembly includes a housing portion comprising a first latch element, a mounting member adapted to mount to a wall or other structure, a push plate movably mounted to the housing portion, and a signal generator. The mounting member includes a second latch element. The first and second latch elements cooperate to selectively secure the housing portion to the mounting member. The signal generator is connected to the housing with respect to the push plate such that the push plate selectively moves to selectively activate the signal generator when a force is exerted on the push plate.

A push plate assembly includes an assembly housing, a push plate, a signal generator, a biasing member, and an antenna holder. The assembly housing includes a non-metallic sidewall. The push plate movably mounts in the assembly housing. The signal generator is disposed in the assembly housing. The biasing member is disposed between the push plate and the signal generator. The biasing member biases the push plate away from the signal generator. The antenna holder is disposed in or adjacent the sidewall of the assembly housing. The antenna holder is adapted to retain an associated antenna near or spaced externally from a peripheral edge of the push plate.

DETAILED DESCRIPTION

Figure 1:
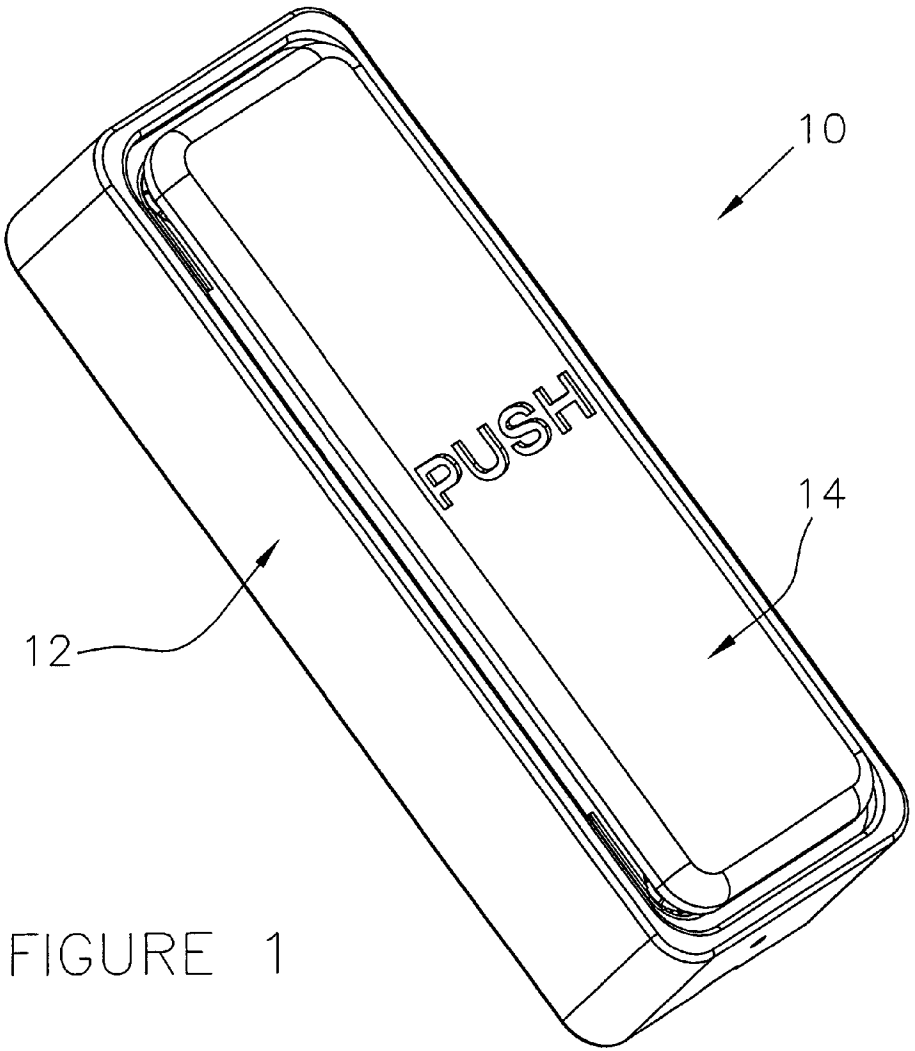
FIG. 1 is a perspective view of a first embodiment of a push plate assembly.
Figure 45:
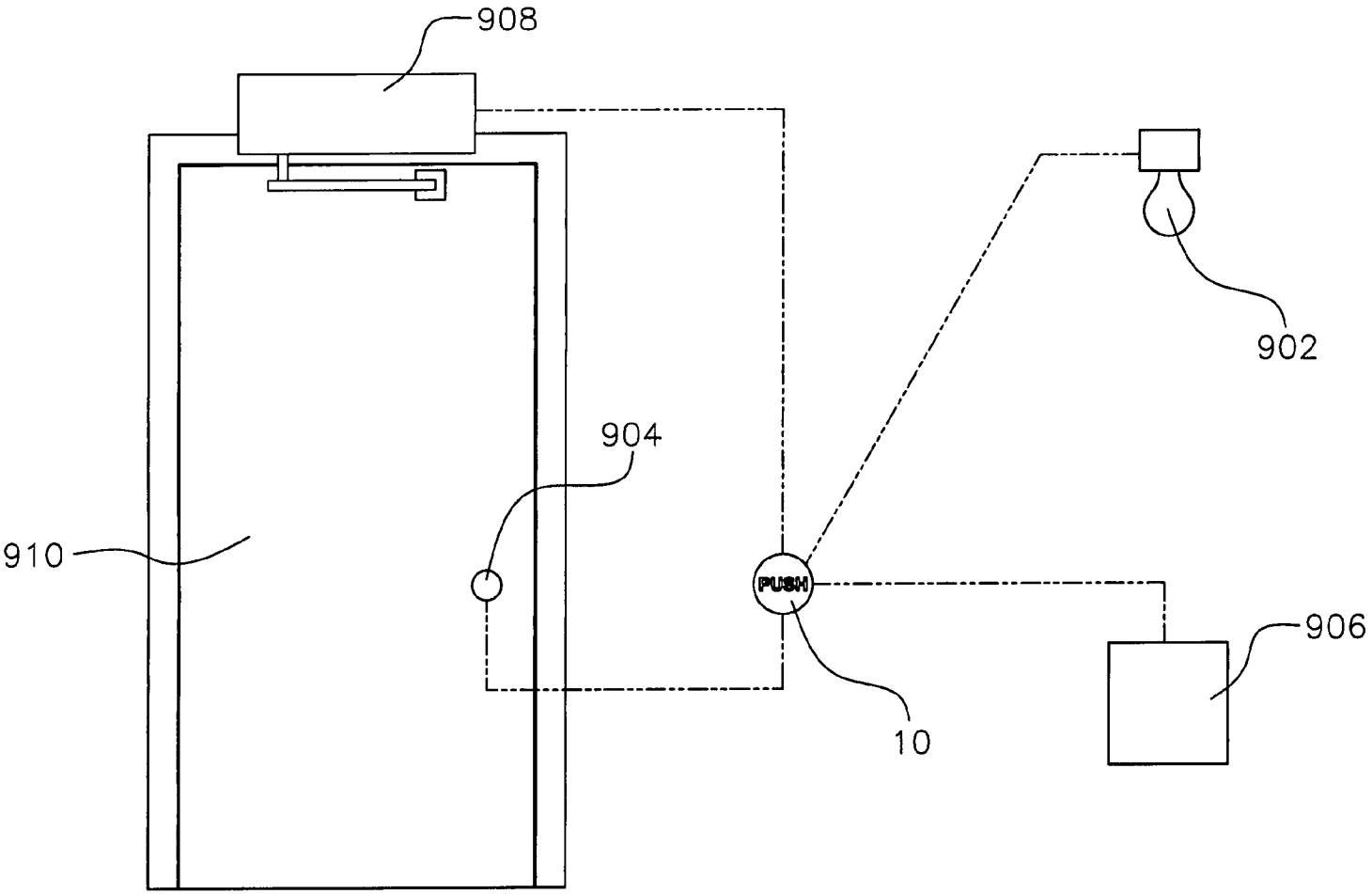
FIG. 45 is a schematic view of a push plate assembly in communication with actuating devices.

With reference to FIG. 1, a push plate assembly 10 generally includes a housing 12 and a push plate 14. A signal generator (not visible in FIG. 1) in the housing 12 communicates with a receiver housed in an automative door opener 908 (FIG. 45) to open a door 910 (FIG. 45) in response to a signal sent by the signal generator. As depicted in FIG. 45, the signal generator can also or alternatively communicate with other receivers to control such things as door locks 904, alarms 906 (door and fire alarms), lights 902 and other items. The assembly 10 can be used with any conventional automative door opener that can receive a signal, for example a door opener found in a handicapped entrance, and for the sake of brevity will be described in this environment; however, the assembly is not limited to uses only in this environment. The assembly can be hard wired to the door opener or the assembly can remotely communicate with the door opener via a signal sent through the air.

In the embodiment depicted in FIG. 1, the push plate 14 and the housing 12 are generally rectangular in shape; however, the push plate and the housing can be other configurations such as square, circular, oval-shaped, etc. In the depicted embodiment, the push plate 14 is made from a flat piece of metal; however, the push plate in this and in the other embodiments need not be flat and it can take other configurations such as for example a convex button. The push plate 14 has a beveled periphery that slopes toward the housing 12 to decrease the likelihood of a passerby snagging an item such as a purse or clothing on the push plate. The beveled edge of the push plate 14 does not extend outward from the housing 12, thus not creating a gap between the two, also decreasing likelihood of a passerby snagging an item of clothing or other object on the push plate 14.

Figure 2:
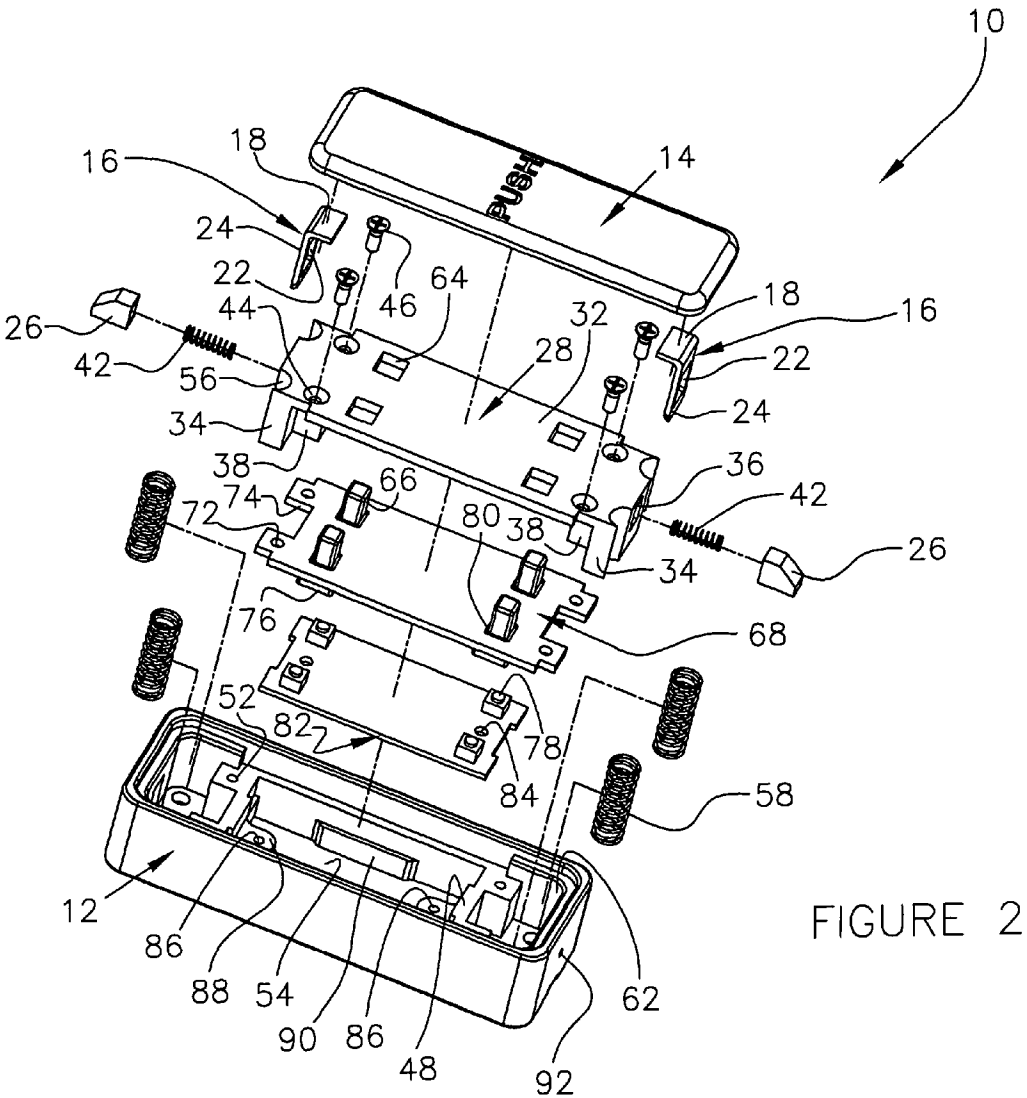
FIG. 2 is an exploded view of the push plate assembly of FIG. 1.

With reference to FIG. 2, a pair of push plate latch strikes 16 attach the push plate 14 to the housing 12. The push plate latch strikes 16 are a latch element for securing the push plate 14 in the housing 12. In this embodiment, the latch strikes 16 attach to and depend from opposite longitudinal ends of the push plate 14. Each push plate latch strike 16 is generally L-shaped having a push plate mounting surface 18 that attaches to the push plate 14 via spot welding or other conventional manners. Also, the push plate 14 and the latch strikes 16 can be formed from one piece of material, such as steel. Each push plate latch strike 16 also includes a latch opening 22 formed through a leg 24 that is at a right angle to the push plate mounting surface 18. The opening 22 is generally rectangular in shape and receives latches 26 to attach the push plate 14 to an inner compartment lid 28. The latches 26 also form a latch element for securing the push plate 14 in the housing 12.

The inner compartment lid 28 includes an upper plate 32 having side walls 34 depending from the upper plate. Rectangular openings 36 (only one visible in FIG. 2) are formed in each side wall 34. Latch housings 38, which in the embodiment depicted are integral with the side walls 34, also depend from the upper plate 32. The openings 36 in each side wall 34 provide access to the latch housings 38. In an alternative embodiment, the latch housings 38 need not be integral with the side walls 34.

Figure 3:
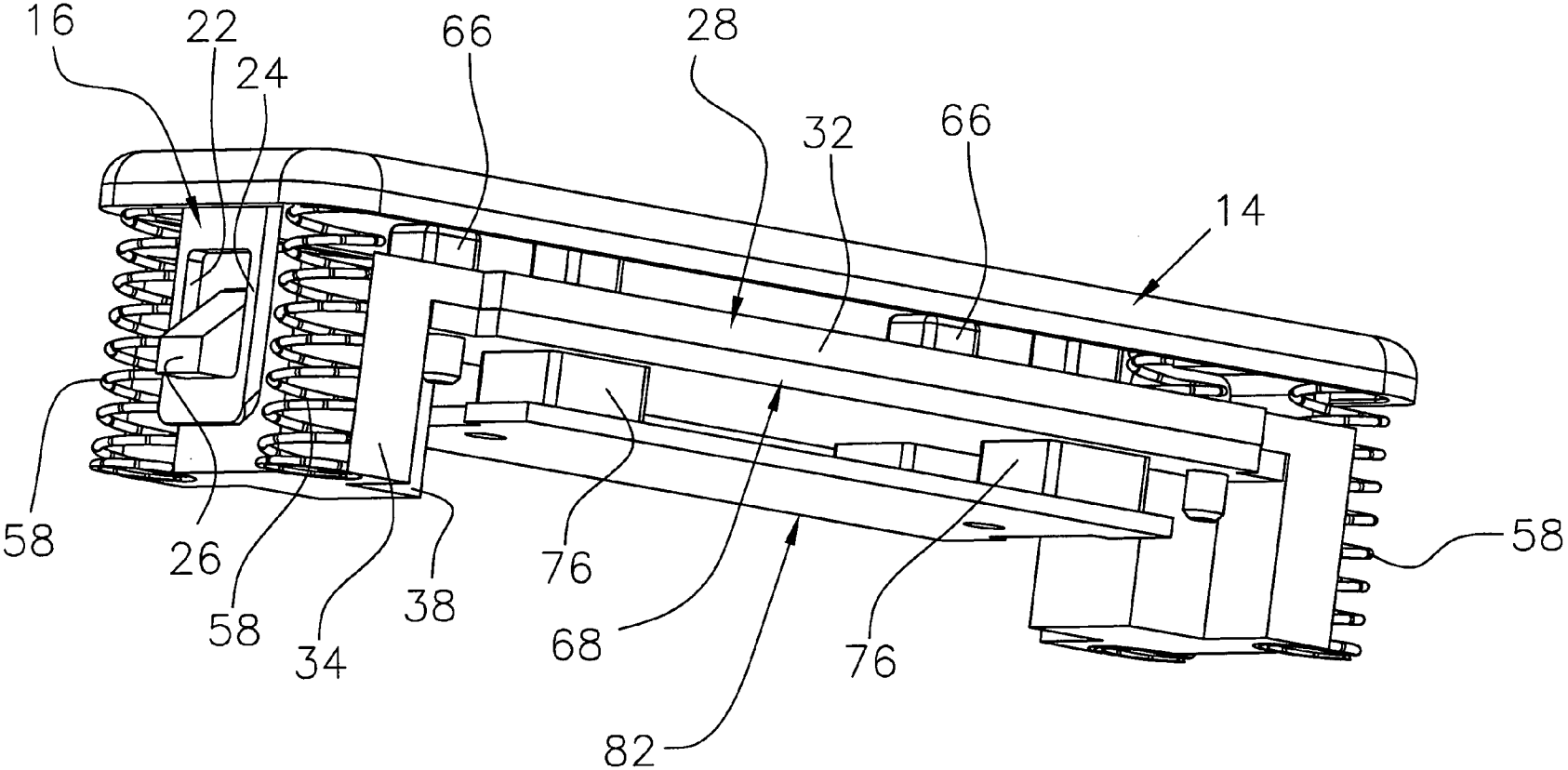
FIG. 3 is a side perspective assembled view of the push plate assembly of FIG. 1 with a housing removed from the assembly to show the internal components of the assembly.

The openings 36 and the latch housings 38 receive biasing members 42, which in this embodiment are coil springs, and the latches 26. The latches 26 are hollow to receive the coil springs 42 and the coil springs bias the latches outward from longitudinal ends of the inner compartment lid 28. With reference to FIG. 3, the opening 22 in the push plate latch strike 16 has a height greater than the height of latch 26 to allow for back and forth (up and down in the figure) movement of the push plate 14 in the housing 12 (not shown in FIG. 3). The width of the opening 22 is larger than the width of the latch 26, which allows the push plate 14 to rock side to side for easier activation of switches described below. The latch 26 has a flat bottom that complements the rectangular opening 22 of the push plate latch strike 16.

In an alternative embodiment, the latches can be other shapes that cooperate with openings of other shapes. In one non-limiting example, the latches can be biased round pegs that are received in longitudinal slots. In this embodiment, the longitudinal slots can be oval-shaped to allow for side to side rocking. In another alternative embodiment, the biased latch can be replaced with a set screw that screws into and unscrews out of the inner compartment lid. The set screw can cooperate with a bushing to selectively fasten the push plate to the inner compartment lid while allowing for movement of the push plate with respect to the lid. For example, the set screw can reside in an oval-shaped opening similar to the opening described above, where the set screw can selectively unscrew out of the opening to remove the push plate from the inner compartment lid. In another alternative, the latch strikes 16 can be biased or resilient and include a member to allow for connection to the housing 12 and/or the inner compartment lid 28. Also, the latch strike can be a latching element that includes a surface that is not defined by an opening, for example the latching element could only include a notch. The latch can cooperate with this notch.

Referring back to FIG. 2, the inner compartment lid 28 includes four fastener openings 44 that receive fasteners 46 to attach the inner compartment lid 28 to the housing 12. The housing 12 includes an internal wall 48 that includes four openings 52 that align with the openings 44 in the inner compartment lid 28 to receive the fasteners 46 to attach the inner compartment lid 28 to the housing 12. The internal wall 48 spaces the upper plate 32 of the inner compartment lid 28 from a bottom wall 54 of the housing 12, which provides room for the latch housing 38.

Figure 4:
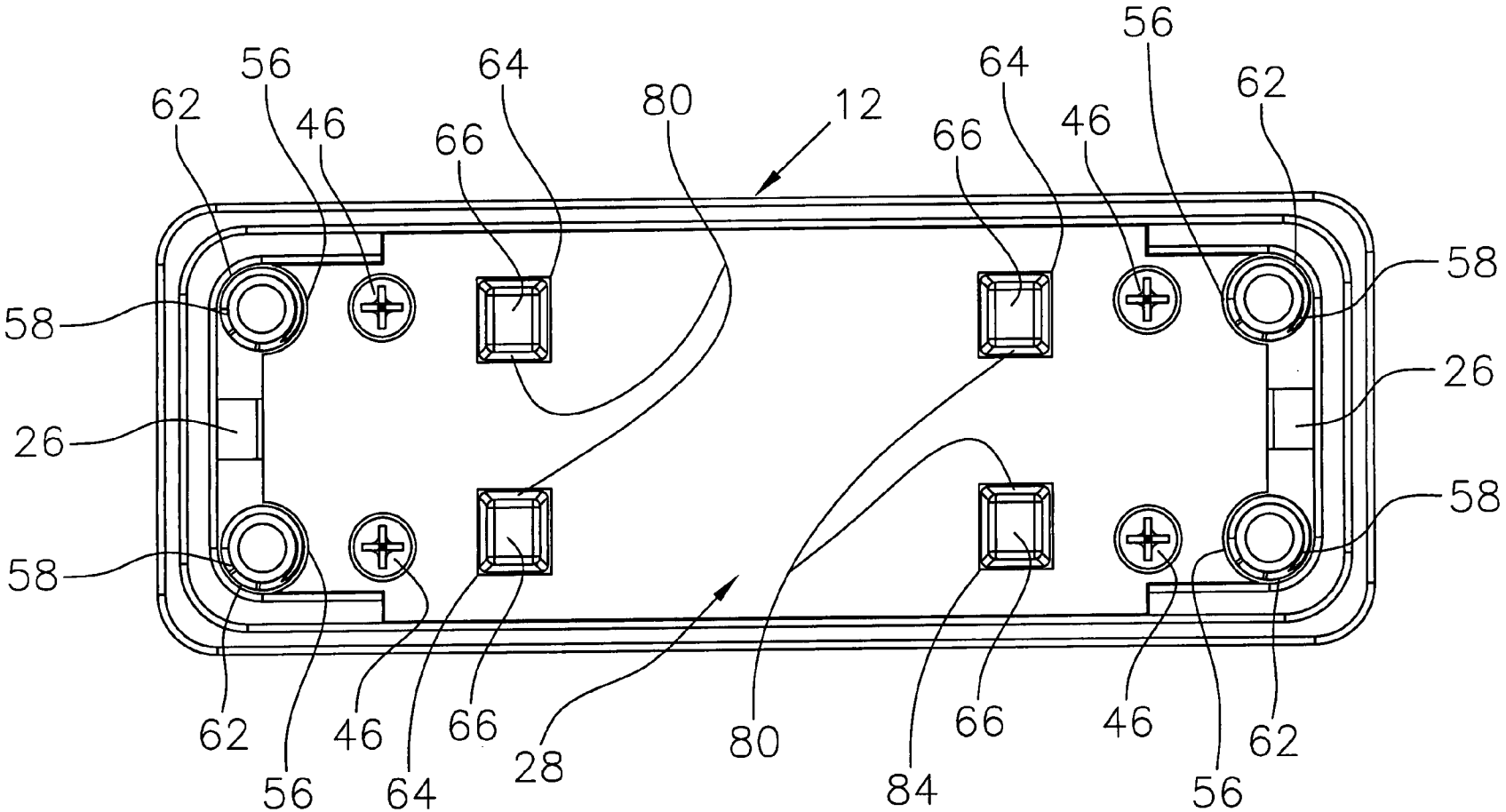
FIG. 4 is a front view with a push plate removed from the assembly to show an inner compartment lid assembled in the housing of the push plate assembly of FIG. 1.
Figure 5:
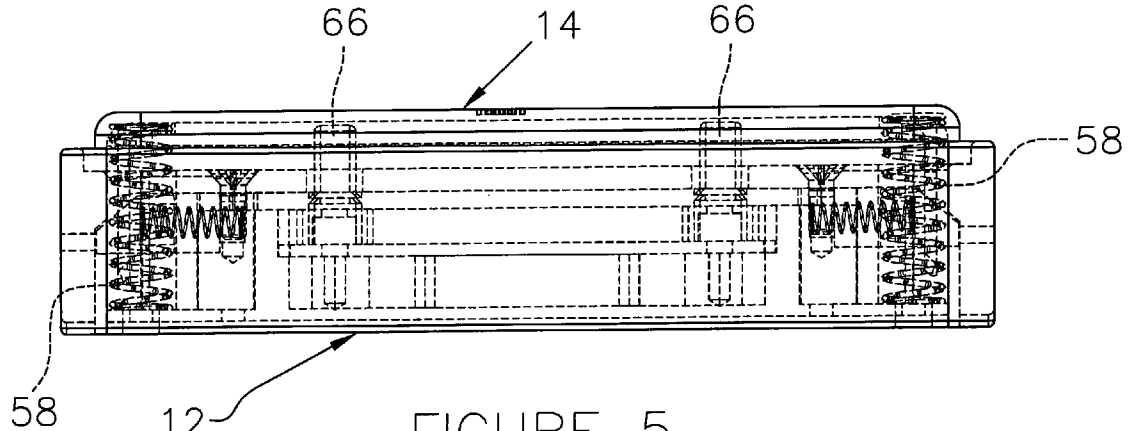
FIG. 5 is a side view of the push plate assembly of FIG. 1 with internal components shown in phantom.
Figure 6:
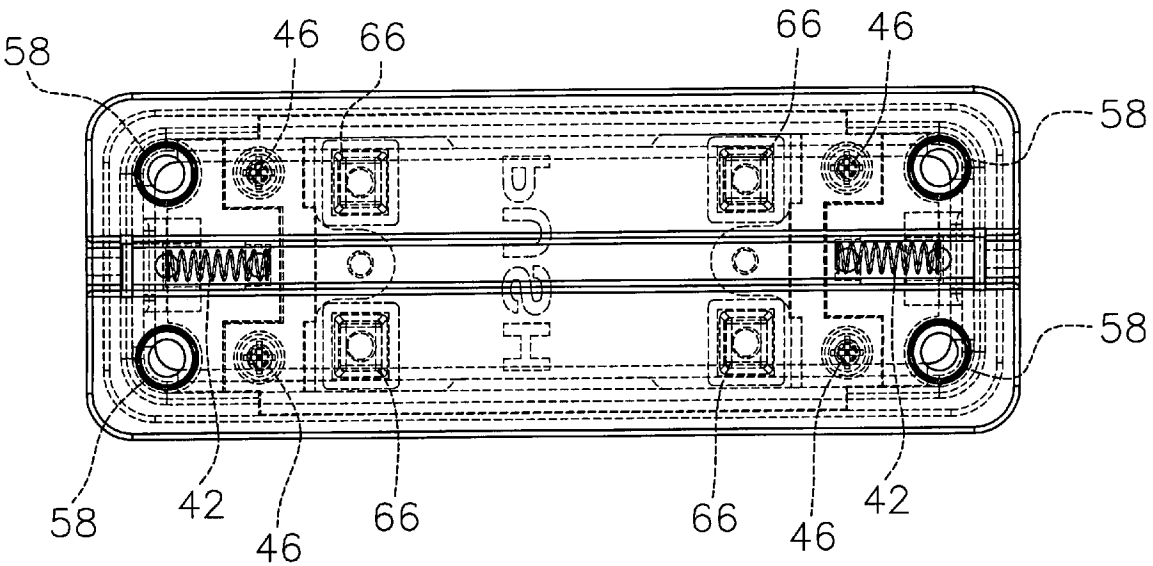
FIG. 6 is a rear view of the push plate assembly of FIG. 1 with internal components shown in phantom.

The inner compartment lid 28 also includes four curved vertical indentations 56 located adjacent the four corners the inner compartment lid. The curved indentations or depressions 56 are arc shaped having a radius slightly larger than the radius of four coil springs 58 received in the housing 12. The coil springs 58 are received in the housing 12 adjacent inside corners that have a curved inner surface 62 having a radius slightly larger than the coil springs 58, as more clearly visible in FIG. 4. The coil springs 58 act as stand offs to space the push plate 14 the appropriate distance from buttons 66 that activate the signal generator, which will be described in more detail below. Accordingly, movement along a longitudinal axis of each spring 58 is not impeded by the curved depressions 56 or the curved inner surface 62, but movement lateral to the longitudinal axis of the coil springs 58 is limited by the curved depressions 56 and the curved inner surface 62.

In an alternative embodiment fewer than four springs can be used, one example attaching one end of a spring centrally on the inner compartment lid 28 and attaching the other end to the push plate 14. In another alternative embodiment, other resilient members can be used to bias the push plate, which need not be coil springs.

The inner compartment lid 28 includes four button openings 64 that receive buttons 66 mounted to and/or integral with a switch push pad 68. With reference to FIG. 3, the four buttons 66 extend from the switch push pad 68 through the openings 64 in the inner compartment lid 28 toward a lower or inner surface of the push plate 14. Preferably, the buttons 66 contact the push plate 14. The springs 58 bias the push plate 14 away from the housing 12 (not shown in FIG. 3), and thus away from the buttons 66 until the latches 26 contact the leg 24 of the latch strike 16. No adjustment of the push plate 14 with respect to the buttons 66 is required. Because the opening 22 in the latch strike 16 is slightly larger, in both length and width, the push plate 14 swivels to contact the buttons 66. As mentioned above, other resilient members can be used to bias the push plate 14, for example the rubber buttons 66, due to the inherent resiliency of the rubber, can also bias the push plate 14. The flat bottom of the latch 26 engages a surface of the opening 22 in the latch strike 16 that is disposed farthest from the push plate 14 to limit the movement of the push plate away from the buttons 66 as the springs bias the push plate away from the buttons.

The switch push pad 68 also includes four fastener openings 72 that align with the fastener openings 44 in the inner compartment lid 28 and the openings 52 in the housing 12 to attach the switch push pad 68 to the housing 12. The switch push pad 68 also includes two notches 74 that receive the latch housing 38 when the inner compartment lid 28 and the switch push pad 68 are received in the housing 12. The buttons 66 extend upwardly from switch push pad 68 and are made from a solid rigid somewhat pliable material such as rubber. Stand-offs 76 depend from the switch push pad 68 underneath each button 66. The stand-offs 76 surround switches 78, as seen in FIG. 3, in a manner to keep the bottom of the buttons 66 slightly above the switches. A bellows/compression member 80 is formed on each button 66 where the button contacts the switch push pad 68. The bellows/compression member 80 allows for downward and side to side movement of the button 66 to activate the switch 78. The switch push pad 68, the buttons 66, the bellows/compression members 80 and the stand-offs 76 can be formed from a single piece of rubber that acts as a gasket for a circuit board 82, which is the signal generator in this embodiment. The stand-offs 76 keep the bottom of the button 66 a proper distance above the switches 78, even when a material that is subject to creep is used to form the switch push pad 68.

The circuit board 82 includes circuitry and other devices that allow the circuit board deliver a signal via the air, i.e., a wireless signal, or the circuit board can include circuitry to allow a signal to be sent over wires, i.e., a hard wired unit. The circuit board 82 includes two fastener openings 84 that align with openings 86 in a ledge 88 that extends from the bottom wall 54 of the housing 12. The ledge 88 along with longitudinal side ledges 90 (only one visible in FIG. 2) space the circuit board 82 from the bottom wall 54. The openings 84 and 86 receive fasteners (not shown) to attach the circuit board 82 to the housing. As seen in FIG. 2, the circuit board 82 resides within the inner wall 48 of the housing 12. The switch push pad 68 is preferably made of a water-proof material, such as rubber, to protect the circuit board 82 housed inside the inner wall 48 from the elements. The switch push pad 68 acts as a gasket sealing the inner wall 48 when it is attached thereto.

The switches 78 can be conventional plunger-type switches, or other known switches and/or sensors including Hall-effect sensors and light optoelectric sensors, and the like. Where a sensor, e.g. a position sensor, is used the push plate can connect to a member, such as a probe and the sensor can detect the position of the probe. Four switches 78 are disclosed; however, one switch or a plurality of switches can be used with the push plate assembly 10. The switches 78 open and close circuits in a known manner so that a signal can be delivered. The signal can include an RF signal, an infrared signal or another conventional signal to a door opener. Also, as mentioned above, the assembly can be wired to the door opener and the signal can be sent via the wire. The circuit board 82 is powered by a power source (not shown). The power source can include a solar power source, an AC power source or a DC power source such as batteries.

Openings 92 are provided in the housing 12 to allow the removal of push plate 14 from the housing 12. To remove the push plate 14 a tool such as an Allen wrench is inserted into the opening 92 to contact the latch 26 depressing the latch into the latch housing 38. With the latch 26 no longer contacting the leg 24, the plate 14 can be removed. With the push plate 14 removed access is provided to the fasteners 46 so that a power source can be replaced or maintenance can be performed on the internal components of the assembly 10. As is apparent in FIG. 1, the opening 92 in the housing side wall is such that the latch 26 does not extend through the opening. Because of this configuration, tampering with the internal components of the assembly is thwarted because removal of the push plate requires a tool. Alternatively, the openings 92 can be covered, for example with a screw or a keyhole, to further limit access to the opening. As mentioned above, an Allen wrench can also be inserted into the opening 92 to engage the set screw in an embodiment having a set screw and bushing arrangement selectively fastening the push plate 14 to the inner compartment lid 28.

To actuate the opening of a door, a user pushes push plate 14 anywhere on the push plate to activate one of the switches 78, and the switches are connected in parallel to deliver the same signal to the signal generator. Since a plurality of buttons 66 are provided to activate a plurality of switches 78, the location of the force exerted on the push plate 14 to activate the switch is not critical. Furthermore, because of the manner of how the push plate 14 is mounted to the housing 12, the amount of force required to activate the switch is greatly reduced as compared to known push button switches.

Figure 7:
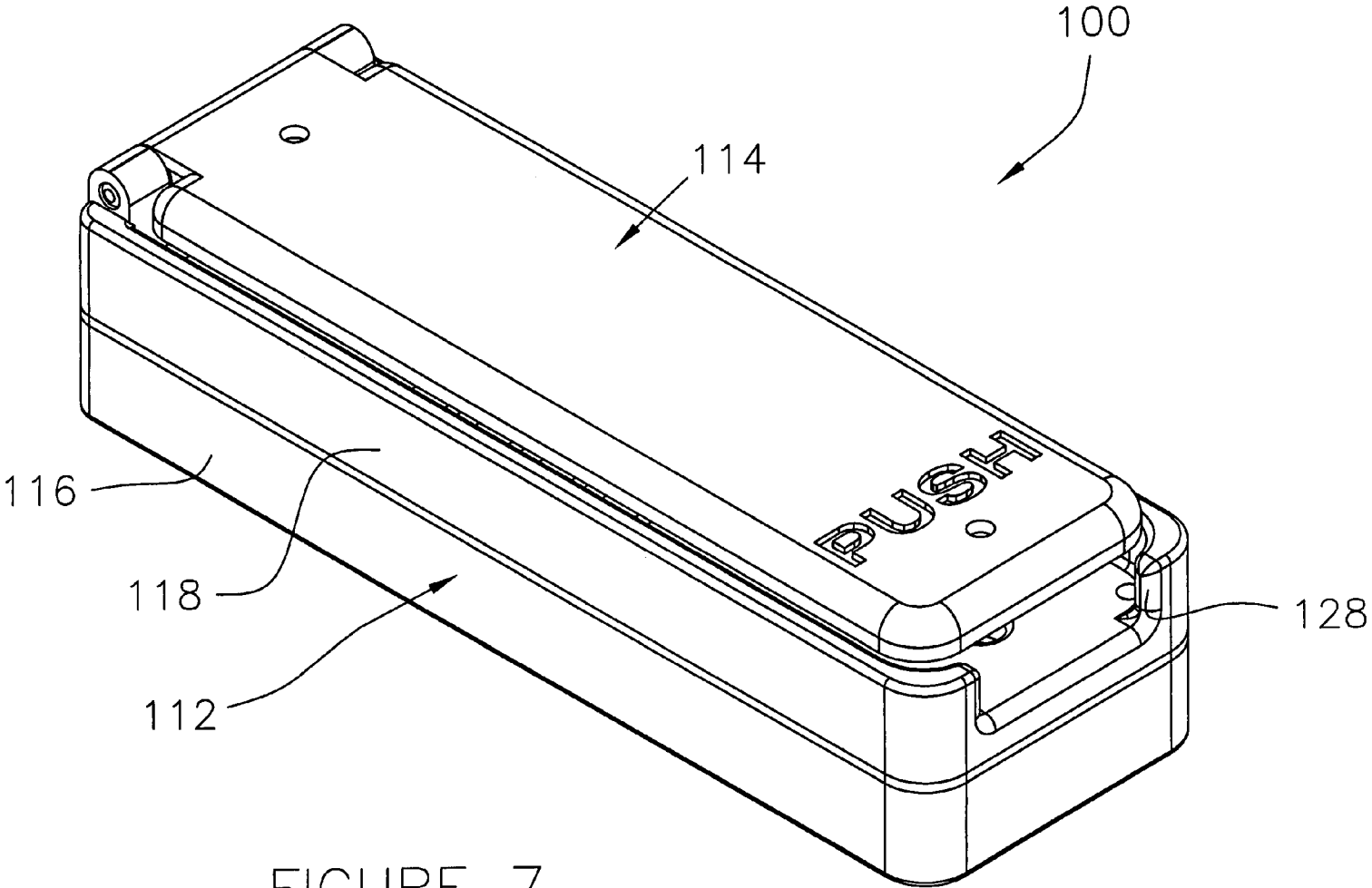
FIG. 7 is a perspective view of a second embodiment of a push plate assembly.

With reference to FIG. 7, another embodiment of a push plate assembly 100 is shown that includes a housing 112 and a push plate 114. The push plate assembly 100 of FIG. 7 is similar to the assembly 10 of FIG. 1 in that a signal generator in the assembly 100 communicates with a receiver similar to the assembly 10 described above. The signal can be sent either through the air or through a wire to the receiver.

The housing 112 includes a base housing 116 attached to a keypad housing 118. The push plate 114 has a beveled periphery that slopes toward the keypad housing 118 similar to the push plate 14 described above. The beveled edge of the push plate 114 does not extend outward from the keypad housing 118, decreasing the likelihood of a passerby snagging an item on the push plate 114. The push plate 114 pivotally attaches to the keypad housing 118.

Figure 9:
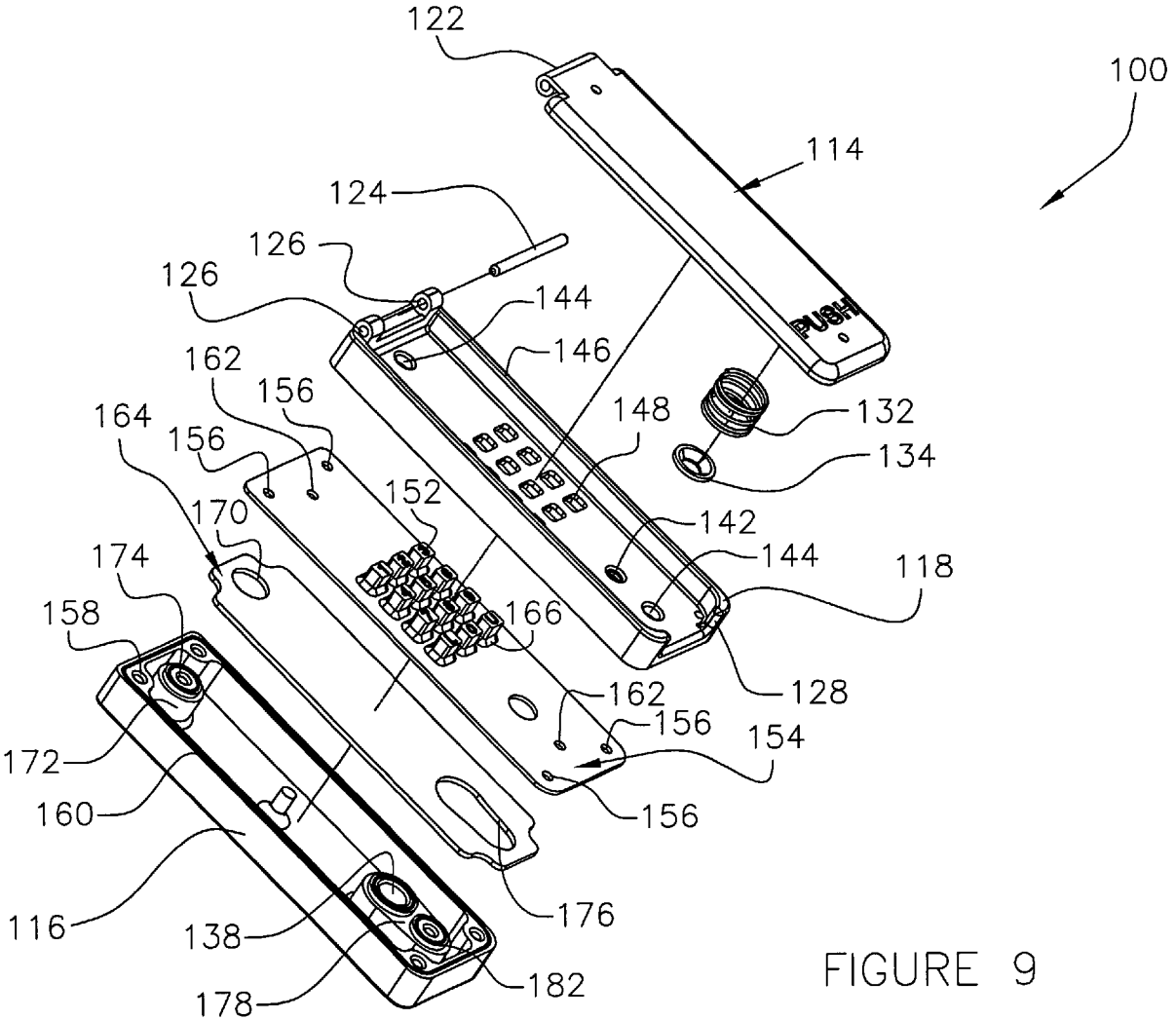
FIG. 9 is an exploded view of the push plate assembly of FIG. 7.
Figure 10:
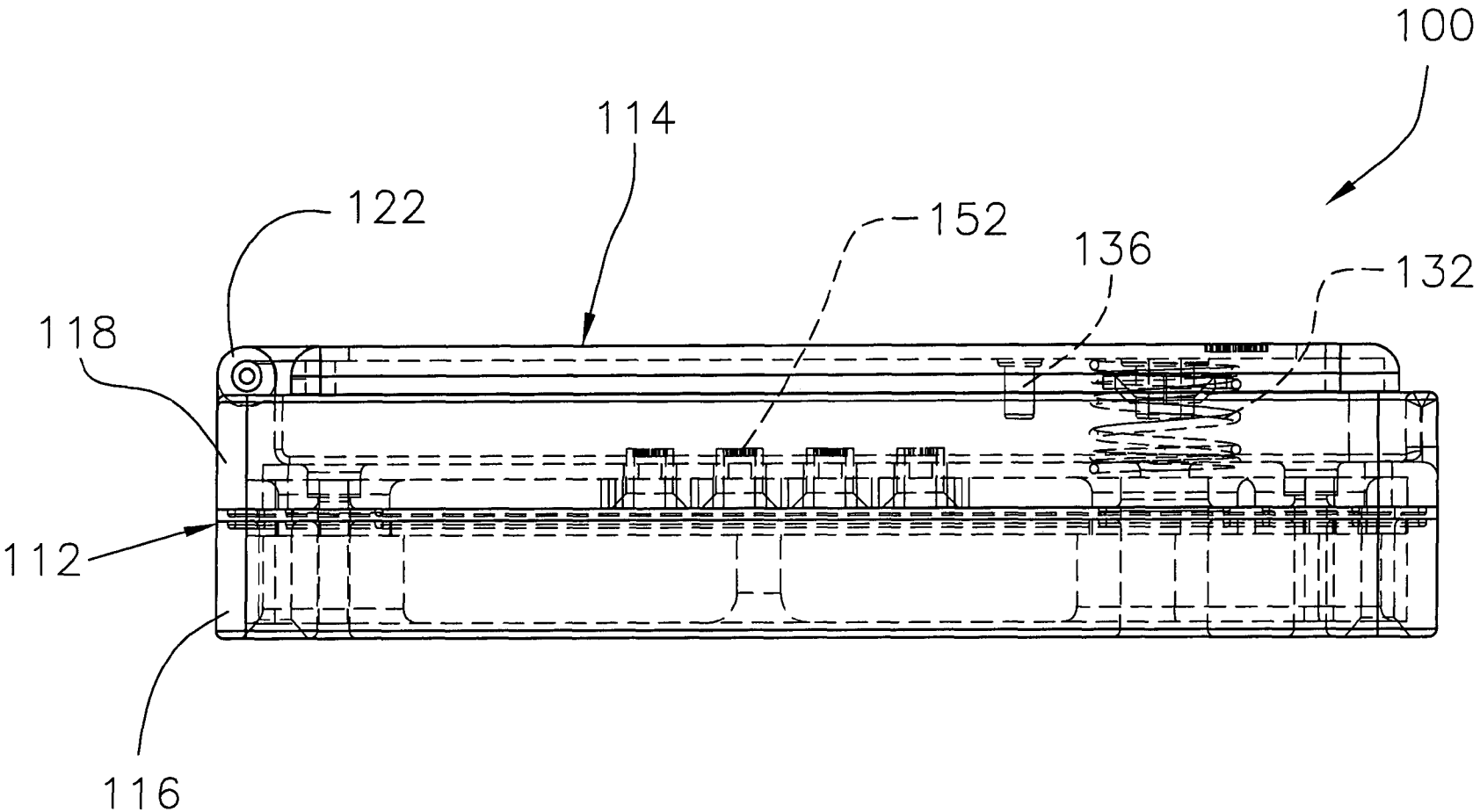
FIG. 10 is a side view of the push plate assembly of FIG. 7 with internal components shown in phantom.

With reference to FIG. 9, the push plate 114 includes a loop 122 that receives a pin 124. The keypad housing 118 includes loops 126 that align with the loop 122 of the push plate 114 to receive the pin 124 to provide a hinge attachment between the push plate 114 and the keypad housing 118. The hinge attachment is shown at a longitudinal end of the push plate 114 and keypad housing 118; however, the components can be attached elsewhere or in other manners.

Figure 8:
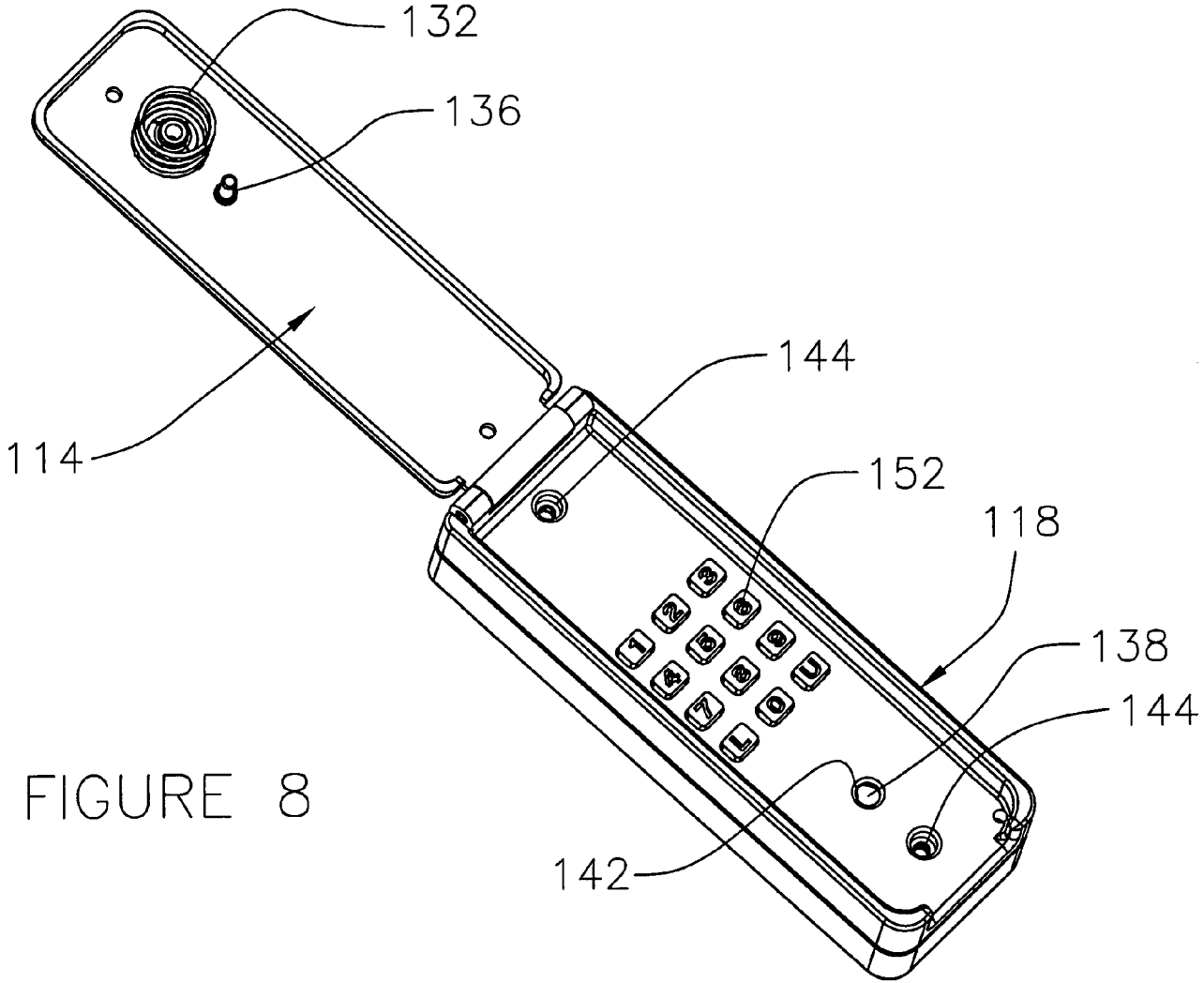
FIG. 8 is a perspective view of the push plate assembly of FIG. 7 with a push plate in an open position exposing a push keypad.

With reference to FIG. 8, the push plate 114 can flip up and away from the keypad housing 118, i.e., an open position. With reference back to FIG. 7, a notch 128 is formed in the keypad housing 118 opposite the hinge connection so that an operator's finger, or the like, can be inserted into the notch to flip up the push plate 114.

Referring again to FIG. 8, a biasing member 132, which in this embodiment is a coil spring, attaches to an inner surface of the push plate 114. Referring to FIG. 9, a spring retainer 134 is used to fasten and retain the spring 132 against the inner surface of the push plate 114. Referring back to FIG. 8, the spring 132 is positioned near an end of the push plate 114 opposite the hinge connection and biases the push plate 114 away from the keypad housing 118. In an alternative embodiment, the spring 132 can attach to the keypad housing 118 or it can be positioned elsewhere on the push plate assembly 100, i.e. near the hinge connection. A projection or probe 136 also protrudes from an inner surface of the push plate 114. The projection 136 cooperates with a positioning sensor 138 that is accessible through an opening 142 in the keypad housing 118. The positioning sensor 138 can be a Reed sensor where the projection 136 is or has a magnet attached to it. The position sensor 138 can be another conventional position sensor, or the like, that detects the position of the push plate 114.

The keypad housing 118 includes upper and lower mounting openings 144 that receive fasteners (not shown) to mount the assembly 100 to a desired structure. The keypad housing 118 also includes a raised peripheral wall 146, where the notch 128 is formed in the raised peripheral wall. The peripheral wall 146 protects keys 152 mounted to a push keypad 154 that are received in the keypad openings 148.

The push keypad 154 includes fastener openings 156 that align with openings 158 formed in an inner ledge 160 in the base housing 116 to attach the keypad housing 118 to the base housing 116. The push keypad 154 can be made from a solid rubber material, or the like, to act as a gasket that presses against the inner ledge 160 to protect a circuit board 164, described below, from the elements. The push keypad 154 also includes mounting openings 162 that align with mounting openings 144 in the keypad housing 118. The keys 152 on the push keypad 154 contact switches (not shown) on the circuit board 164. A corresponding bellows/compression member 166 is formed on each key 152 at the intersection between the key 152 and the push keypad 154. The bellows/compression member 166, similar to the member 80 described above, allows for side to side as well as downward movement of the key 152 to contact the switches on the circuit board.

The circuit board 164 is similar to the circuit board 82 described with reference to FIGS. 1-6 in that the circuit board 164 includes circuitry and other devices that generates a signal that can be delivered through the air, e.g. an RF signal, or that can be transmitted through a wire. The circuit board 164 is positioned between the push keypad 154 and the base housing 116. Also the position sensor 138 can mount to or near the circuit board 164 and also communicate via circuitry with the circuit board. The circuit board 164 includes an upper opening 170 located near its top to receive a boss 172 in the base housing 116. The boss 172 includes mounting opening 174 that aligns with upper mounting opening 144 in the keypad housing 118 and the upper opening 162 in the push keypad 154. The circuit board 164 also includes a lower opening 176 that receives a lower boss 178 in the base housing 116. The lower boss 178 includes a mounting opening 182 that aligns with lower mounting opening 144 in the keypad housing 118 and the lower opening 162 in the push keypad 154. The lower boss 178 also includes a recess into which the sensor 138 mounts.

The circuit board 164 can communicate with an automative door opener when the projection 136, which is mounted to the push plate 114, is detected by the position sensor 138. The keypad 154 having the keys 152 mounted thereto is provided to also transmit signals to either the automative door opener or another receiver, such as an automative door lock, or another type receiver via the circuit board 164. The buttons 152 on the keypad can contact switches (not shown) on the circuit board 164 that communicate through known circuitry to the receiver. The keypad 154 can be provided in instances where the operator would like to shut-off power to the assembly 100, perhaps at the close of business. Also, the keypad 154 can be used to turn on the assembly 100. The keypad 154 can also be used to turn off and on an alarm system and/or lock or unlock an automative door lock by using different keypad combinations.

The circuit board 164 is powered by a power source (not shown). The power source for the assembly can include a solar power source, an AC power source or a DC power source such as batteries. The transmitter can include an RF transmitter, an infrared transmitter or another conventional transmitter to deliver a signal to a door opener. Also, as mentioned above, the assembly can be wired to the door opener and the signal can be sent via the wire.

Figure 11:
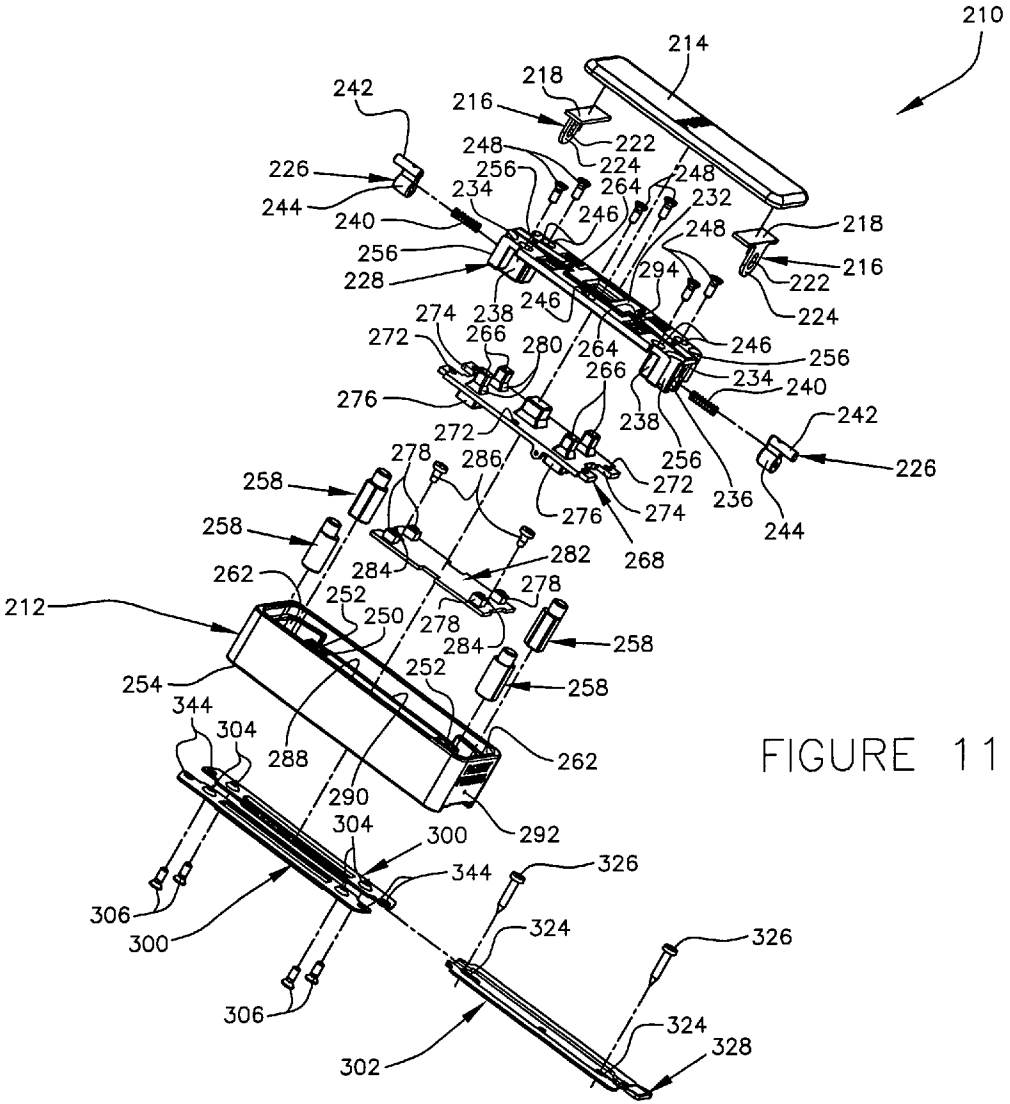
FIG. 11 is an exploded view of a third embodiment of push plate assembly.

A push plate assembly 210 according to yet another embodiment is depicted in FIGS. 11-18. This embodiment also includes a housing 212 and a push plate 214. With reference to FIG. 11, the push plate 214 and the housing 212 are generally rectangular in shape; however, the push plate and the housing can be other configurations. The push plate 214 has a beveled periphery that slopes toward the housing 212. As more clearly seen in FIG. 18, the edge of the push plate 214 does not extend from the housing 212, thus not creating a gap between the two, thereby decreasing likelihood of a passerby snagging an item of clothing or other object on the push plate 214.

A pair of push plate strike plates 216 attach to and depend from opposite longitudinal ends of the push plate 214. The push plate strike plates 216 are a latch element for securing the push plate 214 in the housing 212. Each push plate strike plate 216 is generally L-shaped having a push plate mounting surface 218 that attaches to the push plate 214 via spot welding or other conventional manners. Also, the push plate 214 and the strike plates 216 can be formed from one piece of material, such as steel. Each push plate latch strike 216 also includes a latch opening 222 formed through a leg 224 that is at a right angle to the push plate mounting surface 218. The opening 222 is generally elliptical in shape and receives latches 226 to attach the push plate 214 to an inner base housing lid 228. The latches 226 are also latch elements for securing the push plate 214 in the housing 212.

The inner base housing lid 228 includes a top portion 232 having side walls 234 depending from the upper plate. Openings 236 (only one visible in FIG. 11) are formed in the side walls 234. Latch housings 238, which in the embodiment depicted are integral with the side walls 234, also depend from the upper plate 232. The openings 236 in the side wall 234 provide access to the latch housings 238. In an alternative embodiment, the latch housings 238 need not be integral with the side walls 234.

The openings 236 and the latch housings 238 receive biasing members 240, which in this embodiment are coil springs, and the latches 226. The latches 226 include an upper peg 242 attached to a lower spring receptacle 244. The peg 242 in the embodiment depicted is cylindrical; however, the peg can be other suitable shapes. The peg 242 is received in the opening 222 in the push plate strike plate 216. The spring receptacle 244 is hollow to receive the coil springs 240, which bias the latches 226 outward from longitudinal ends of the inner base housing lid 228. The opening 222 in the push plate strike 216 has a height greater than the diameter of the peg 242 to allow for back and forth (up and down in the figure) movement of the push plate 214 in the housing 212. The width of the opening 222 is also larger than the diameter of the peg 242, which allows the push plate 214 to rock side to side for easier actuation of switches described below. In alternative embodiments, the latches can be other shapes that cooperate with openings of other shapes. Also, other types of known connectors can be used to secure the push plate 214 in the housing 212.

The inner base housing lid 228 includes four fastener openings 246 that receive fasteners 248 to attach the inner base housing lid 228 to the housing 212. The housing 212 includes a raised internal wall 250 that includes four openings 252 (only two visible in FIG. 11) that align with the openings 246 in the inner base housing lid 228 to receive the fasteners 248 to attach the inner compartment lid 228 to the housing 212. The internal wall 250 spaces the upper plate 232 of the inner compartment lid 228 from a rear or bottom wall 254 of the housing 212, which provides room for the latch housing 238.

The inner base housing lid 228 also includes four curved depressions 256 located adjacent the four corners of the inner base housing lid. The curved depressions 256 are arc shaped having a radius slightly larger than the radius of push plate standoffs 258 received in the housing 212. The standoffs 258 are received in the housing 212 adjacent inside corners that have a curved inner surface 262 having a radius slightly larger than the standoffs 258, as more clearly visible in FIG. 12. Accordingly, movement along a longitudinal axis of each standoff 258 is not impeded by the curved depressions 256 or the curved inner surface 262, but movement lateral to the longitudinal axis of the standoffs 258 is limited by the curved depressions 256 and the curved inner surface 262. The standoffs 258 in the embodiment depicted are generally cylindrical rubber members. The rubber members provide adequate resiliency to bias the push plate 214 after it has been depressed. Also, rubber, or some other elastomeric material, is quiet when expanding and contracting and therefore the push plate assembly 210 does not produce any undesirable noises when the push plate 214 is depressed. In addition to the rubber and elastomeric members described above, other standoff-type members can be used.

Figure 12:
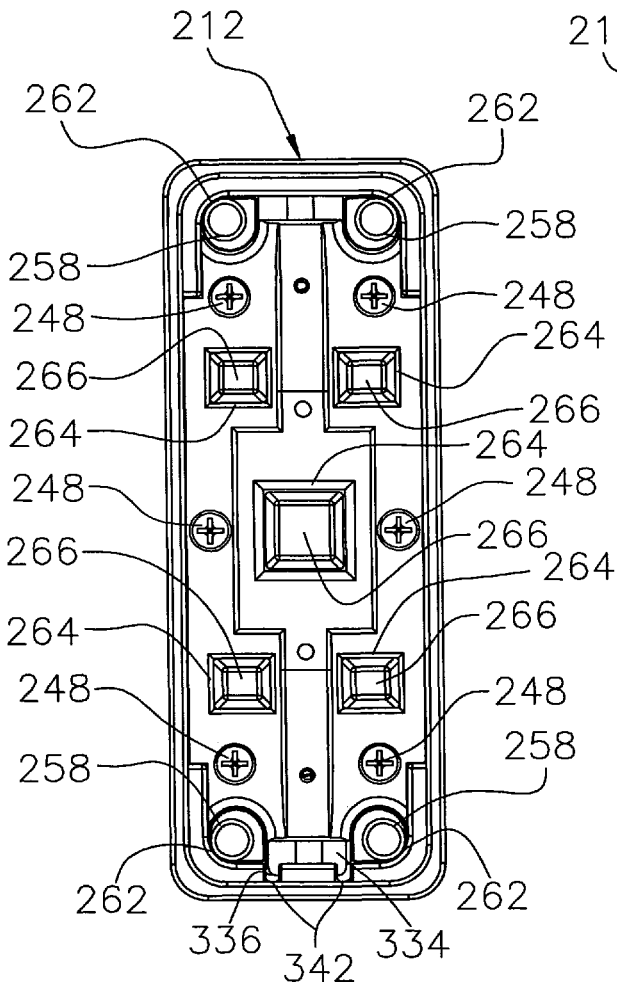
FIG. 12 is a front view of the push plate assembly of FIG. 11 with a push plate removed to show internal components of the push plate assembly.

The inner base housing lid 228 includes five button openings 264 that receive buttons 266 mounted to a switch push pad 268. With reference to FIG. 12, the five buttons 266 extend from the switch push pad 268 through the openings 264 in the inner base housing lid 228 toward a lower or inner surface of the push plate 214. Preferably, the buttons 266 contact the push plate 214. The standoffs 258 bias the push plate 214 away from the housing 212 and thus away from the buttons 266 until the peg 242 of each of the latches 226 contacts the leg 224 of the strike plate 216. No adjustment of the push plate 214 with respect to the buttons 266 is required. Because the opening 222 in the strike plate 216 is slightly larger, in both length and width, the push plate 214 swivels to contact the buttons 266. As mentioned above, other resilient members can be used to bias the push plate 214, for example the rubber buttons 266, due to the inherent resiliency of the rubber, can also bias the push plate 214.

With reference back to FIG. 11, the switch push pad 268 also includes four fastener openings 272 that align with the fastener openings 246 in the inner compartment lid 228 and the openings 252 in the housing 212 to attach the switch push pad 268 to the housing 212. The switch push pad 268 also includes two notches 274 that receive the latch housing 238 when the inner base housing lid 228 and the switch push pad 268 are received in the housing 212. The buttons 266 extend upwardly from switch push pad 268 and are made from a solid rigid somewhat pliable material such as rubber. Stand-offs 276 depend from the switch push pad 268 underneath each button 266. The stand-offs 276 surround the switches 278 in a manner to keep the bottom of the buttons 266 slightly above the switches. A bellows/compression member 280 is formed on each button 266 where the button contacts the switch push pad 268. The bellows/compression member 280 allows for downward and side to side movement of the button 266 to activate the switch 278. The switch push pad 268, the buttons 266, the bellows/compression members 280 and the standoffs 276 can be formed from a single piece of rubber that acts as a gasket for a circuit board 282. The stand-offs 276 keep the bottom of the button 266 a proper distance above the switches 278, even when a material that is subject to creep is used to form the switch push pad 268.

The circuit board 282 includes a circuitry and other electronic devices that allow the circuit board to generate a signal. The circuit board 282 includes two fastener openings 284 that align with openings (not visible) in ledges 288 that extend from the bottom wall 254 of the housing 212. The ledges 288 along with longitudinal side ledges 290 (only one visible in FIG. 11) space the circuit board 282 from the bottom wall 254. The openings 284 in the circuit board 282 and the openings (not visible) in the ledges 288 receive fasteners 286 to attach the circuit board 282 to the housing. The circuit board 282 resides within the inner wall 250 of the housing 212. The switch push pad 268 is preferably made of a water-proof material, such as rubber, to protect the circuit board 282 housed inside the inner wall 250 from the elements. The switch push pad 268 acts as a gasket sealing the inner wall 250 when it is attached thereto.

The switches 278 can be conventional plunger-type switches, or other known switches and/or sensors. The switches are in electronic communication with a transmitter (not shown) located on or in electrical communication with the circuit board 282 and a power source (not shown). The power source can include a solar power source, an AC power source or a DC power source such as batteries. The transmitter can include an RF transmitter, an infrared transmitter or another conventional transmitter to deliver a signal to a door opener. Also, as mentioned above, the assembly can be wired to the door opener and the signal can be sent via the wire. Four switches are disclosed; however, one switch or a plurality of switches can be used with the push plate assembly 210.

An LED (not shown) can be mounted to and/or be in electrical communication with the circuit board 282. An opening 294 is provided in the inner base housing lid 228 through which light can be emitted. Where the LED is mounted directly to the circuit board 282 underneath the switch push pad 268, the switch push pad can be made from a clear or translucent material. The light can emanate between the push plate 214 and the housing 212. The LED can be a multicolor LED, or more than one LED can be provided, so that the light that is emitted can change color in response to a signal. For example, the LED and/or LEDs can emit a first color of light, i.e., green, when the push plate 214 is depressed and emit a second color of light, i.e., red, when the push plate 214 is not depressed. In alternate embodiments, other known light sources can be used to light and/or backlight the assembly 210. Some non-limiting examples of light sources include, incandescent light, fluorescent light, LEDs with light tubes, electroluminescent wires, and other known light sources. Each of these light sources can also include reflectors.

Openings 292 are provided in the housing 212 to allow the removal of push plate 214 from the housing 212. To remove the push plate 214 a tool, such as an Allen wrench, is inserted into the opening 292 to contact the spring receptacle 244 of the latch 226 depressing the latch into the latch housing 238. With the latch 226 no longer contacting the leg 242, the plate 214 can be removed. With the push plate 214 removed access is provided to the fasteners 248 so that a power source such as batteries can be replaced or maintenance can be performed on the internal components of the assembly 210. As mentioned above, an Allen wrench can also be inserted into the opening 292 to engage the set screw in an embodiment having a set screw and bushing arrangement selectively fastening the push plate 214 to the inner compartment lid 228.

A mounting assembly is provided to mount the assembly 210 to a wall (not shown) or another suitable structure. The mounting assembly includes two symmetrical base mounting plates 300 and a wall mounting member 302 that engages the base mounting plates. Each base mounting plate includes two openings 304 that receive fasteners 306 to attach each base mounting plate 300 to the housing 212. In lieu of two base mounting plates, one base mounting plate or a plurality of base mounting plates can be used with the assembly.

Figure 14:
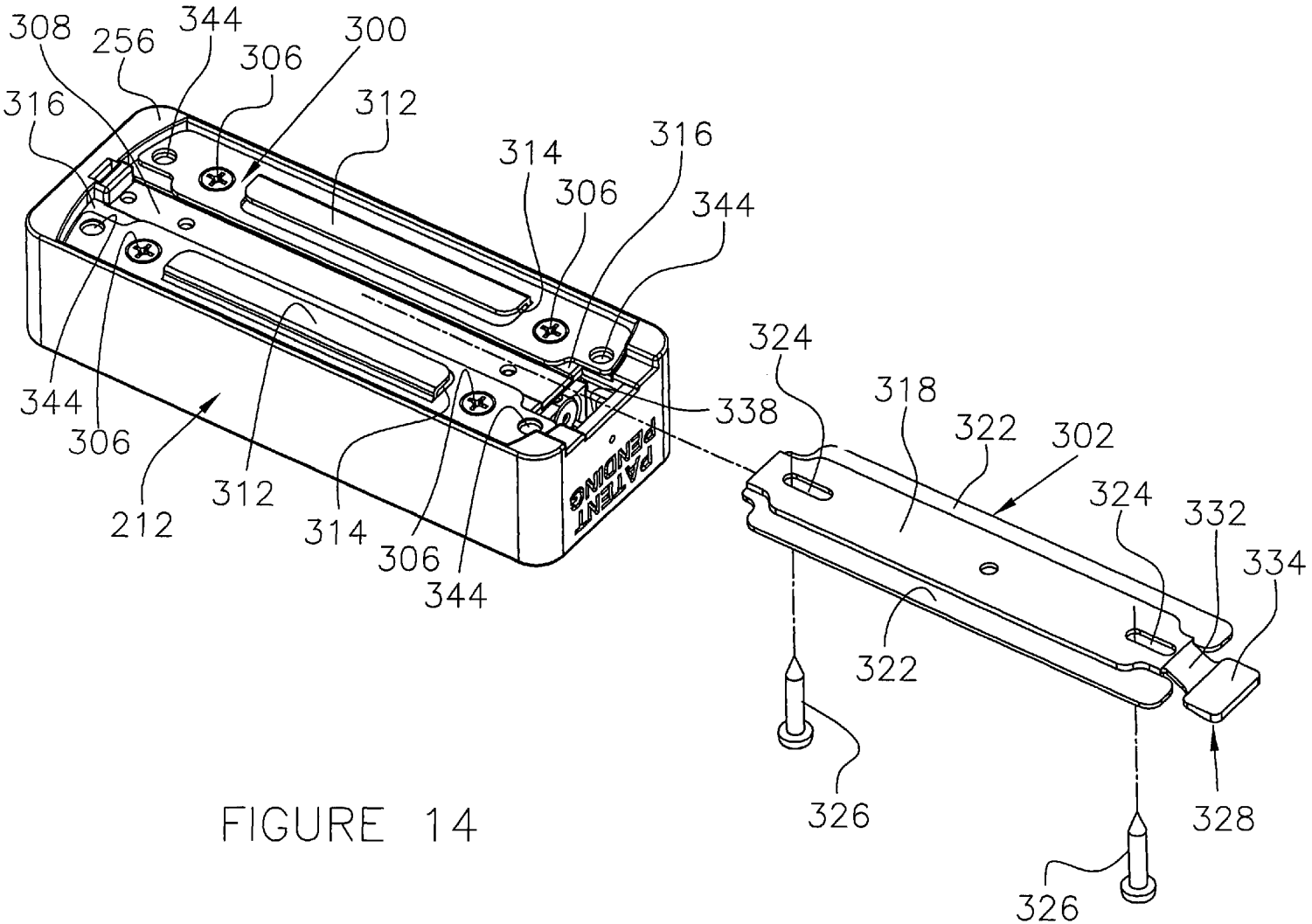
FIG. 14 is a rear perspective view of the push plate assembly of FIG. 11 with a wall mounting plate removed from the housing of the assembly.

With reference to FIG. 14, each base mounting plate 300 includes a longitudinal retaining tab 312. The longitudinal retaining tabs 312 can be punched out of the base mounting plates 300 to define longitudinal slots 314. End notches 316 are defined at the longitudinal ends of the base mounting plate 300. The end notches 316 can form a latch element to secure the housing 212 to the wall mounting plate 302. The rear wall 256 of the housing includes a central recessed region 308 into which the base mounting plates 300 are received. The mounting plates 300 are spaced from and generally parallel to one another. The longitudinal retaining tabs 312 of the mounting plates 300 are flush with the corner portions of rear wall 256 of the housing 212. This allows a more stable mounting of the assembly 210 on the wall or other structure.

The wall mounting member 302 will be referred to as a wall mounting plate since it has a flattened configuration; however, the term plate should not be limited to flat piece having a uniform thickness. The wall mounting plate 302 in this embodiment is not entirely flat and it can take other configurations where it is not entirely flat. The wall mounting plate 302 includes a raised central region 318 and longitudinal side tabs 322 integral with, spaced from and generally parallel to the central region 318 on each longitudinal side of the raised central region 318. The side tabs 322 are received by the slots 314 of the base mounting plates 300. When the wall mounting plate 302 is received by the base mounting plates 300, the raised central region 318 of the wall mounting plate 302 is flush with the longitudinal retaining tabs 312 of the base mounting plate 300 and the raised, which in this embodiment is the peripheral portion, of the rear wall 256. The wall mounting plate 302 also includes two mounting openings 324 that receive fasteners 326 to mount the wall mounting plate 302 to a wall or other structure. The central recessed area 308 on the rear wall 256 of the housing 212 allows for clearance of the head of the fasteners 326 to slide up and down in the recessed area 308 when removing the housing 212 from the wall mounting plate 302.

Figure 15:
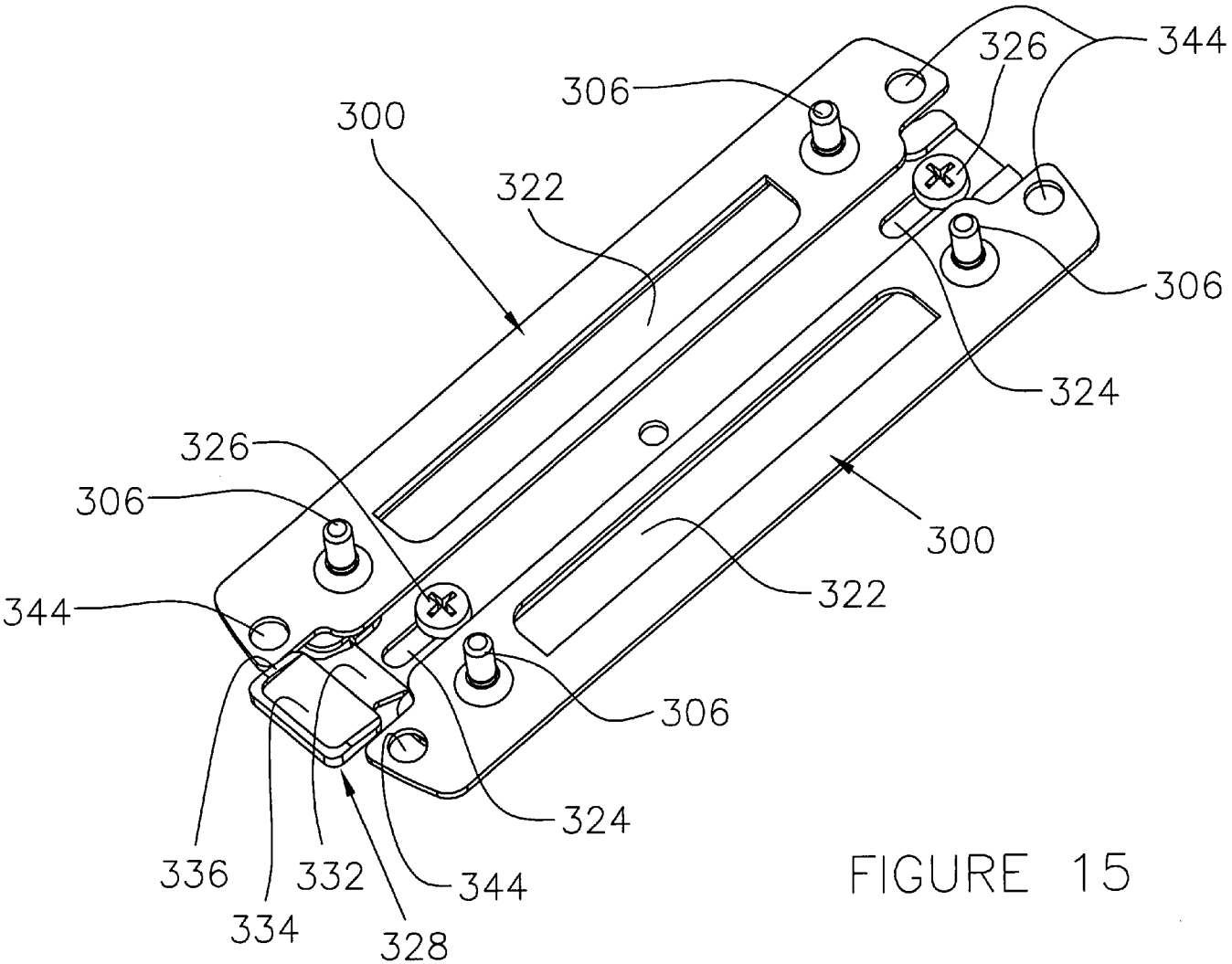
FIG. 15 is a perspective view of base mounting plates of the push plate assembly of FIG. 11 attached to the wall mounting plate.
Figure 16:
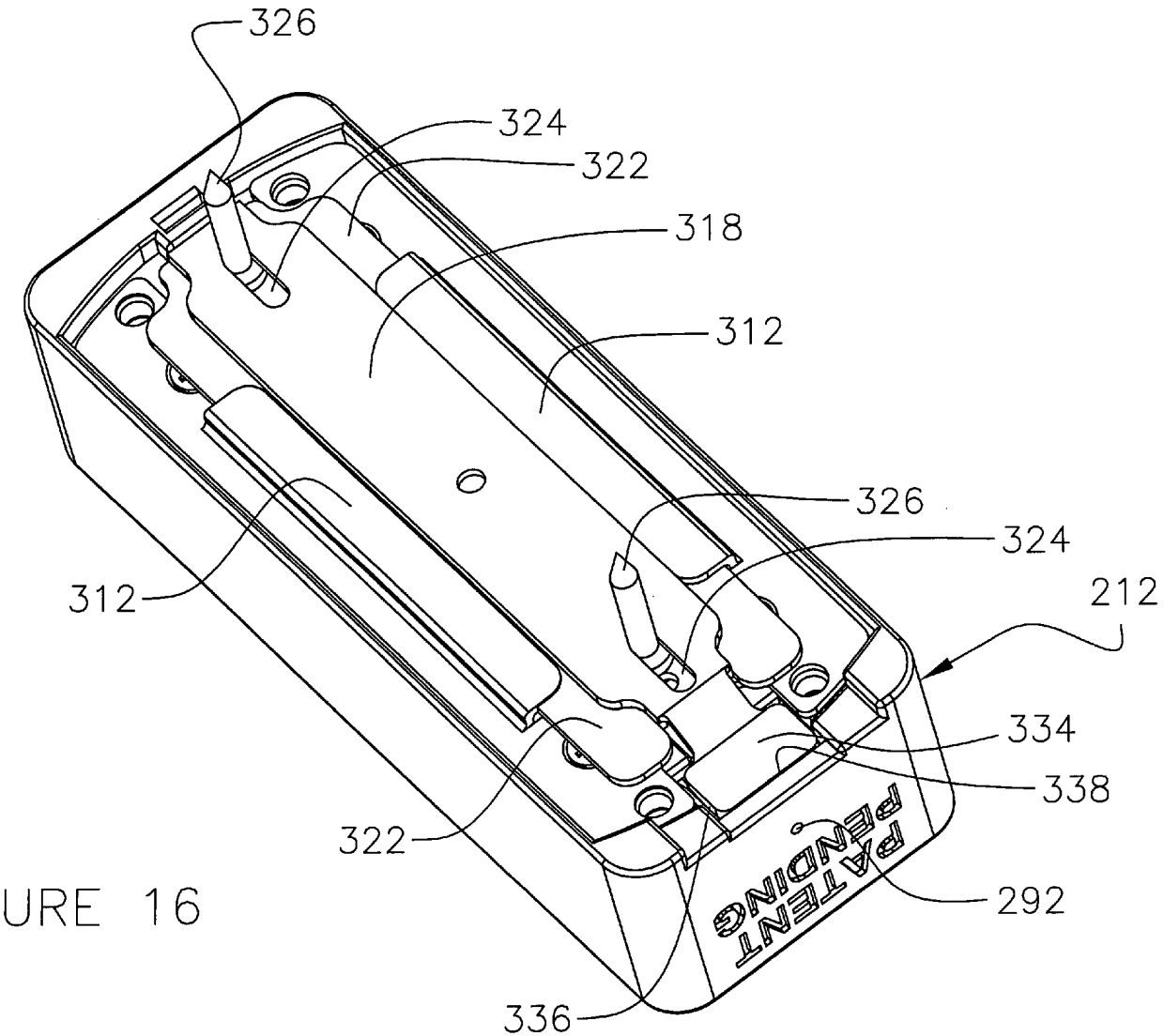
FIG. 16 is a rear view of the push plate assembly of FIG. 11 with the wall mounting plate engaging the base mounting plates.
Figure 18:
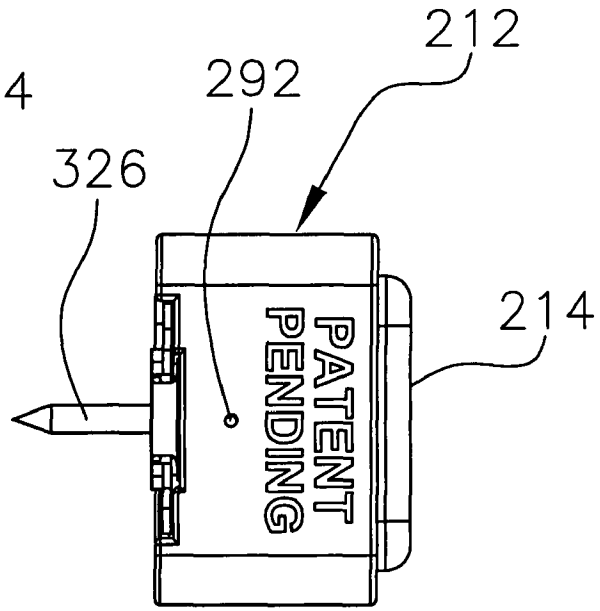
FIG. 18 is a bottom view of the push plate assembly of FIG. 11.
Figure 17:
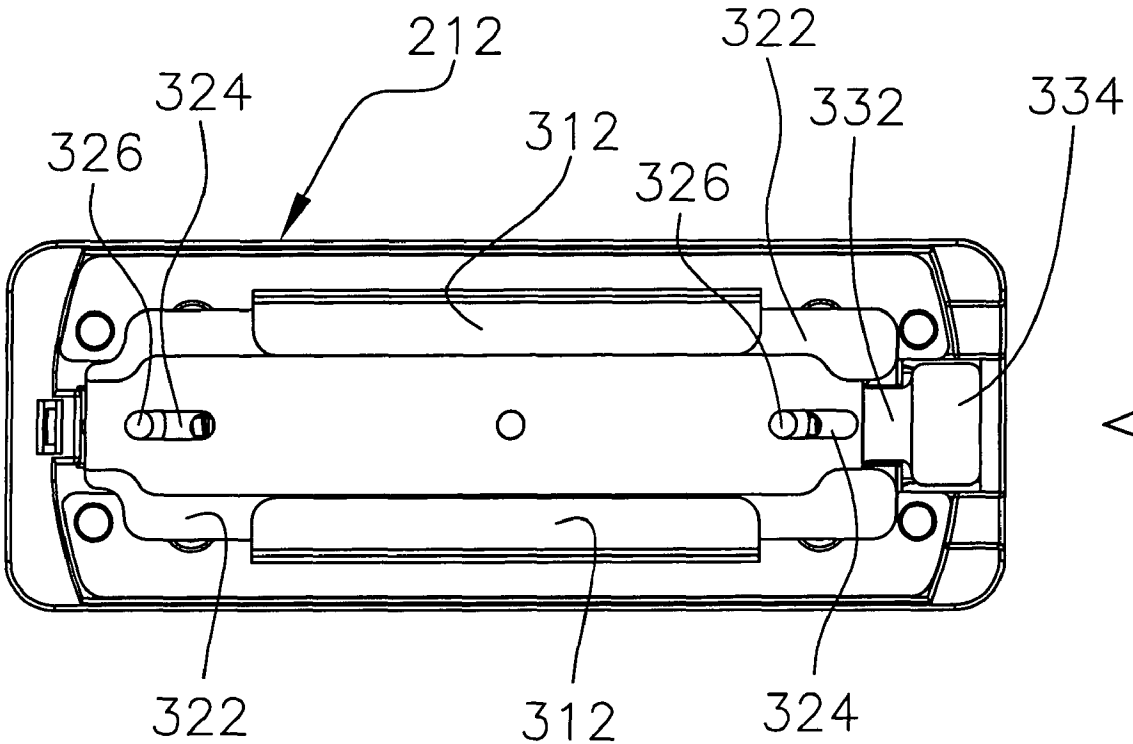
FIG. 17 is a rear view of the push plate assembly of FIG. 11.

The wall mounting plate 302 includes a flexible clip 328 at one end that allows the wall mounting plate 302 to retain the housing 212. The flexible clip 328 can form a latch element that secures the housing 212 to the wall mounting plate 302. The flexible clip 328 includes a resilient spring member portion 332 that extends from the raised central region 318 of the wall mounting plate 302. A tab 334 attaches to the resilient portion 332. The resilient portion 332 is bent towards the housing 212. The tab 334 includes a ramped peripheral edge 336 (FIG. 15). The ramped peripheral edge 336 is retained against an inside wall 338 of the housing 212 as more clearly seen in FIG. 16.

Figure 13:
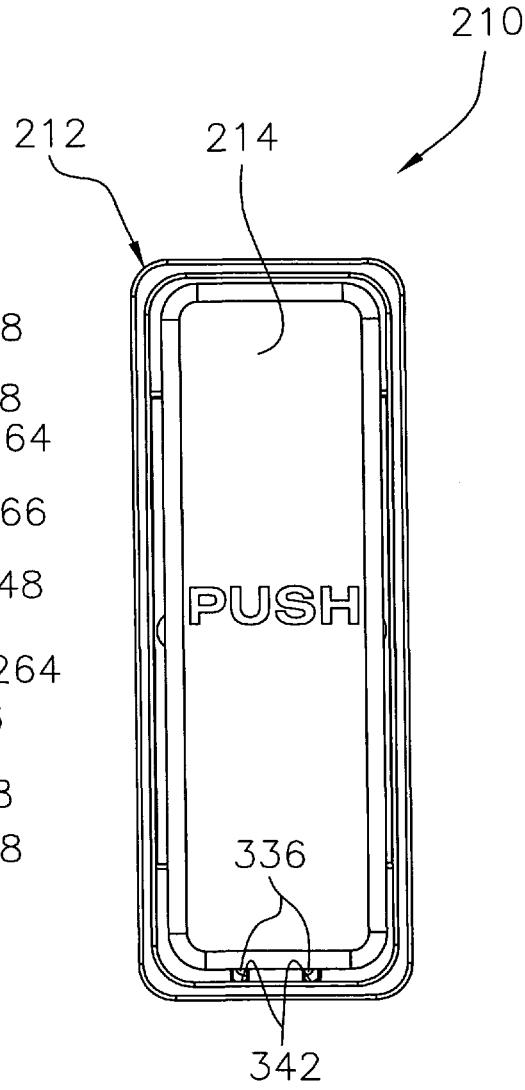
FIG. 13 is another front view of the push plate assembly of FIG. 11 with the push plate attached to the housing.

To remove the housing 212 from the wall mounting plate 302, the tab 334 is pushed away from the inner wall 338 of the housing 212 so that the ramped peripheral edge 336 no longer catches the inner wall 338 and the housing 212 can be slid off the side tabs 322 of each base mounting plate 300. With reference to FIG. 13, a tool, such as an Allen wrench, can be inserted between the face plate 214 and into one of two grooves 342 in the housing 212 to contact the tab 334 to push the peripheral edge 336 away from the inner surface 338 of the housing 212 to allow for detachment.

The mounting assembly allows for easy installation and quick removal of the housing 212 and the push plate assembly 210. Other alternative mounting assemblies are also contemplated. For example, the wall mounting plate 300 can connect to the base mounting plate 302 by a clip attached to one of the plates that engages a receptacle on the other. The plates can selectively attach via a spring-catch, similar to a door latch. Also, a set screw, similar to the alternative described with reference to the alternative latch configuration can also be used. Any conventional assembly that allows for a wall mounting member that allows for easy access to the mounting fasteners and another conventional mounting structure that selectively attaches to the wall mounting member is contemplated. Additionally, mounting holes 344 are provided on the wall mounting plate 300 to mount the push plate assembly 210 to a wall or structure.

Figures 19, 20, 21, 22, 23:
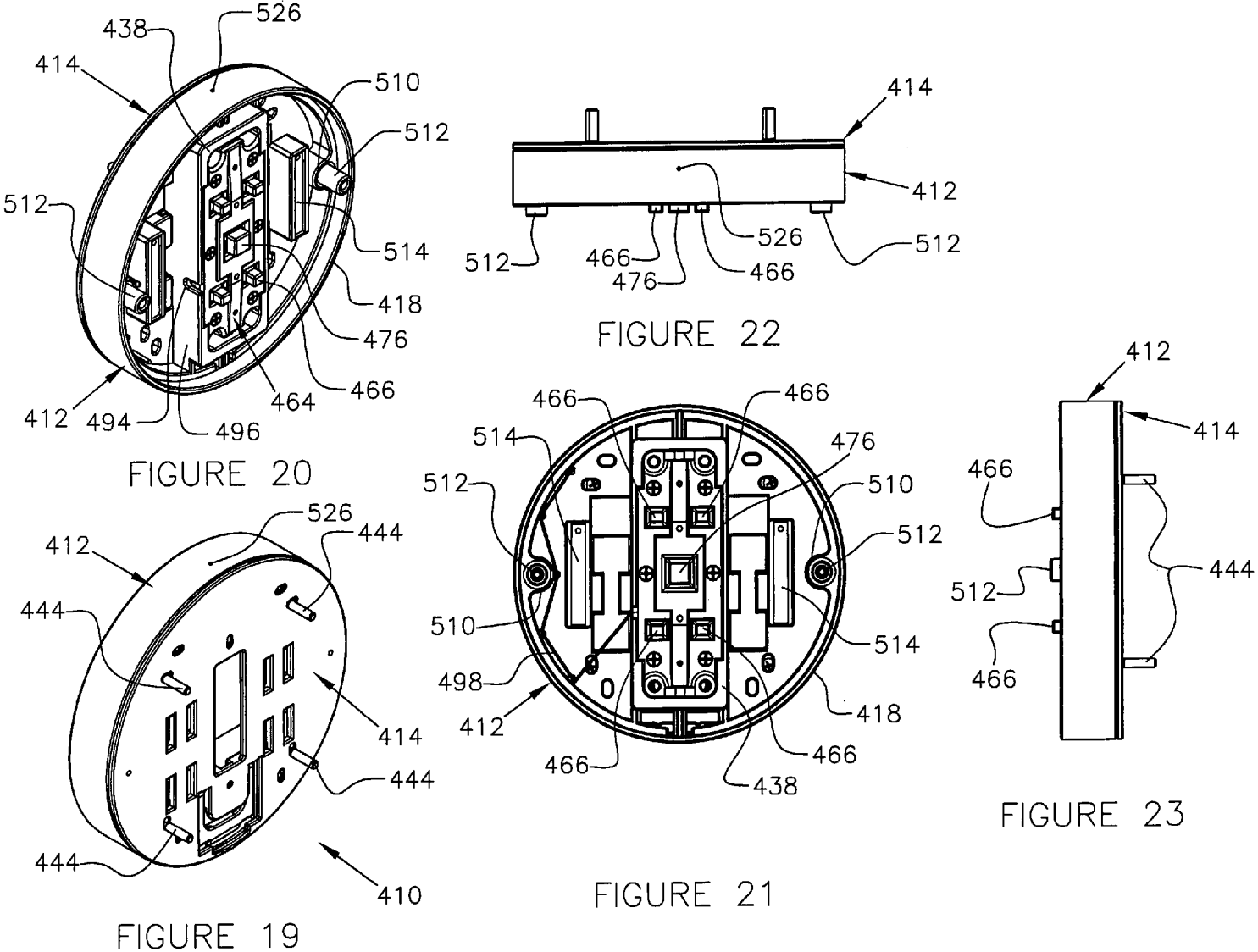
FIG. 19 is a rear isometric view of fourth embodiment of a push plate assembly.
FIG. 20 is a front isometric view of the push plate assembly of FIG. 19 with a push plate removed from a housing.
FIG. 21 is a front view of the push plate assembly of FIG. 19 with the push plate removed and a wire antenna disposed in the housing of the assembly.
FIG. 22 is a bottom view of the push plate assembly of FIG. 19 with the push plate removed.
FIG. 23 is a side view of the push plate assembly of FIG. 19 with the push plate removed.

As seen in FIGS. 19 and 20, push plate assembly 410 according to another embodiment includes a housing 412, a mounting member, or plate, 414 and a push plate 416. The assembly 410 includes a signal generator, which will be described in more detail below, that communicates with a receiver that can be housed in an automative door opener to open a door in response to a signal sent by the signal generator.

In this particular embodiment, the housing 412 includes a cylindrical side wall 418. The side wall 418 protects internal components disposed in the housing 412 from the elements. In this embodiment, the side wall 418 is cylindrical; however, the side wall can take any configuration including rectangular, square, and other shapes. Preferably, the side wall 418 is made of plastic or other durable material. A circular base wall 422 complements and attaches to substantially enclose an end of the cylindrical side wall 418. As more clearly seen in FIGS. 25 and 30, the base wall 422 includes a plurality of mounting holes 424 spaced around the base wall. The mounting holes 424 can receive fastener to allow the housing 412 to mount to a structure such as a wall of a building, a post or other structure.

A rear access door 426 provides access to a signal generator (not visible in FIG. 25), which will be described in more detail below. A plurality of fasteners 428 are provided to attach the rear access door 426 to the base wall 422 to cover a rear opening 430, more clearly seen in FIGS. 29, 30 and 31. The rear access door 426 is provided to allow the assembly to be converted from a remote transmitting assembly to a hardwire assembly. The access door 426 can be removed to allow access to the circuit board 474 (FIG. 31) or can be removed to allow wiring to communicate with a switch 478 (FIG. 30), which will be described in more detail below. A gasket can be provided to cooperate with the access door 426 to protect the internal components of the assembly 410 from the elements.

The mounting plate 414 releasably attaches to the base wall 422 of the housing 412. In one embodiment, the attachment between the mounting plate and the base wall is such that the two are attached together without the use of screws or other similar fasteners. Specifics of the attachment between the mounting plate 414 and the housing 412 will be described; however, the mounting plate 414 can attach to the housing 412 in any conventional manner, such as using fasteners and the like. Selective attachment of the mounting plate 414 to the housing 412 allows for easy removal of the housing from the structure to which the assembly 410 is mounted. Removal of the housing 412 may be required to service the assembly 410, for example to replace the power source or program the circuit board.

Figure 24:
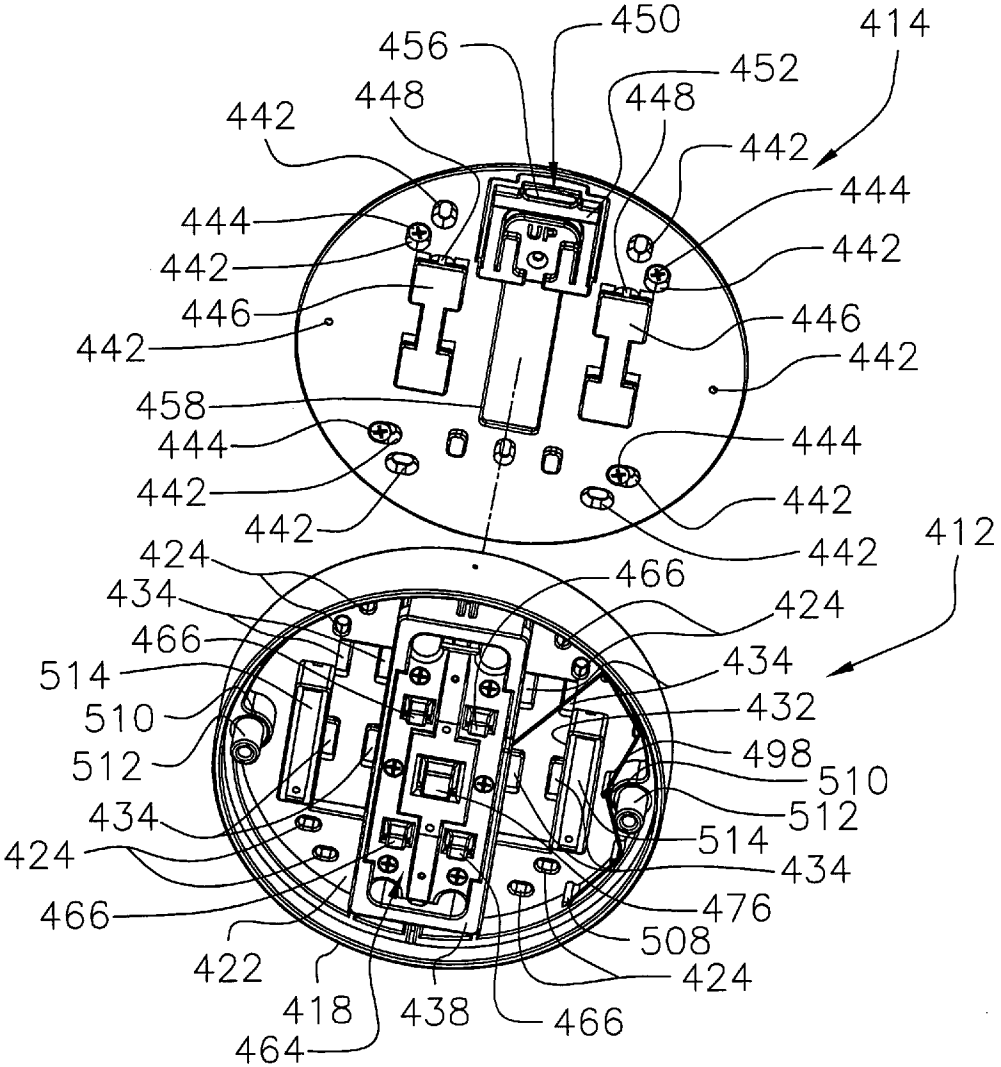
FIG. 24 is a front perspective view of a mounting plate removed from a housing of the push plate assembly of FIG. 19.
Figure 25:
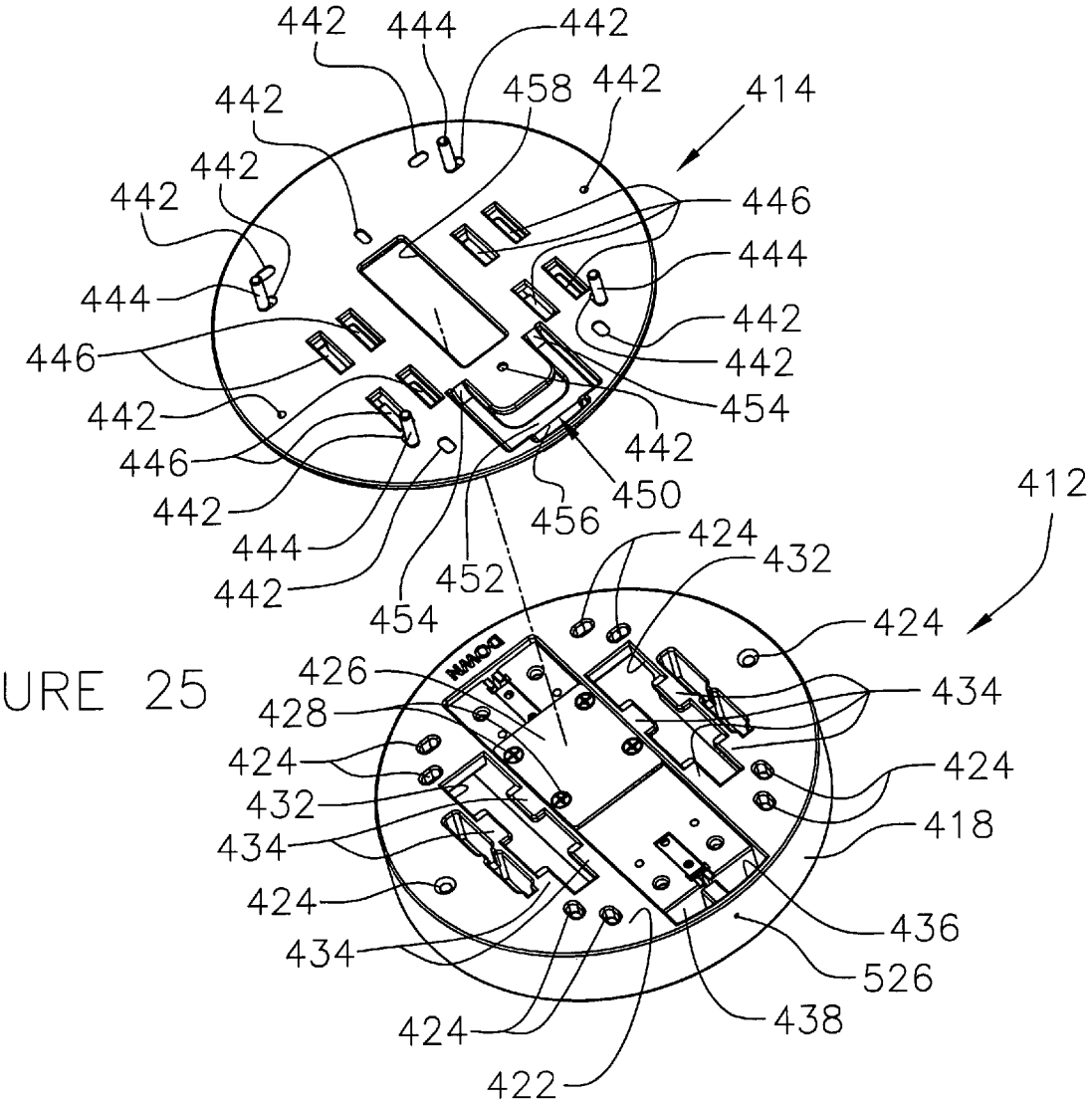
FIG. 25 is rear perspective view of the mounting plate removed from the housing of the push plate assembly of FIG. 19.

In this embodiment, the base wall 422 of the housing 412 includes two keyed slots 432 spaced on opposite sides of the rear access door 426 (FIGS. 24 and 25). The keyed slots 432 can form latch elements to secure the housing 412 to the mounting plate 414. The keyed slots 432 run vertically along the base wall 422 substantially parallel to a vertical axis, which is defined as the vertical diameter of the base wall 422 and the cylindrical side wall 418 relative to the typical orientation of the assembly 410 mounted to a structure. Upper and lower extensions 434 protrude horizontally into the keyed slot 432 to divide the keyed slot into upper and lower wider regions. The extensions 434 run along the length of the keyed slot 432 parallel to the vertical axis. The base wall 422 also includes a snap lock opening 436 defined between the cylindrical side wall 418 and a wall of an internal housing portion 438, which will be described in more detail below.

As mentioned above, the housing 412 releasably attaches to the mounting plate 414. The mounting plate 414 includes a plurality of mounting openings 442 (FIGS. 24 and 25) that receive fasteners 444 to attach the mounting plate 414 to the structure to which the assembly 410 mounts, such as a wall. Referring to FIG. 24, a pair of locking members 446 are spaced from and generally parallel to the mounting plate 414. The locking members 446 can be referred to as latch elements to secure the housing 412 to the mounting plate 414. A support 448 interconnects each locking member 446 to the mounting plate 414. The locking members 446 in this embodiment are a complementary shape to the keyed slot 434 in the base wall 422 of the housing 412. The locking members 446 include upper and lower wider portions that are dimensioned such that they fit into the upper and lower wider regions in the keyed slot 432. To attach the housing 412 to the mounting plate 414, the upper and lower wider portions of the locking members 446 are inserted into the upper and lower wider portions of the keyed slot 432 and the housing 412 is slid downwardly such that the extensions 434 are trapped between the locking members 446 and the base wall 422.

To further secure the housing 412 to the mounting plate 414, the mounting plate 414 also includes a snap lock 450. As best seen in FIGS. 24 and 25, the snap lock 450 includes a resilient U-shaped member 452 attached at each end to the mounting plate 414 via angled portions 454 such that the U-shaped member 452 is spaced from and generally parallel to the mounting plate 414. A knurl 456 depends from the U-shaped member 452 toward the same side of the mounting plate 414 as the locking members 446. As the housing 412 is slid downwardly in relation to the mounting plate 414, or as the mounting plate 414 is slid upwardly in relation to the housing 412, the knurl 456 of the snap lock 450 engages the upper internal housing 438 to secure the mounting plate 414 in relation to the housing 412. The snap lock 450 and the attachment of the mounting plate 414 to the housing 412 in general is described using terms such as "vertical," "up," "down," and the like. These terms are only used to better understand the figures, the orientation of the components is not limited to only those orientations described. For example, the snap lock can be located elsewhere on the housing 412 and the housing 412 could be rotated around its axis to engage with mounting plate 414, i.e., a rotational engagement. In this embodiment the locking members 446 and the slot 432 would be appropriately shaped, e.g. circular.

Figure 29:
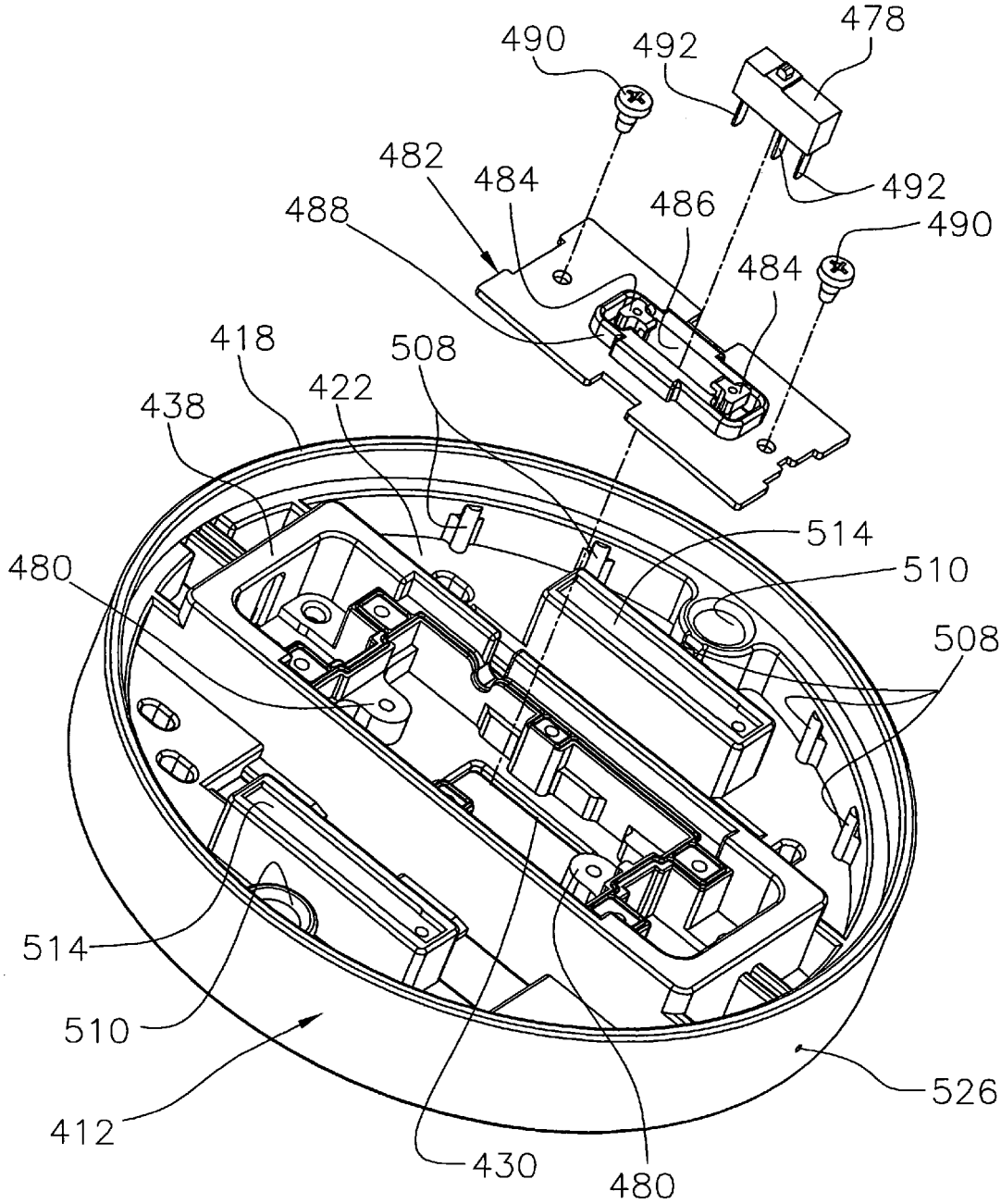
FIG. 29 is an isometric view of a switch and switch holder removed from the housing of the push plate assembly of FIG. 28.
Figure 30:
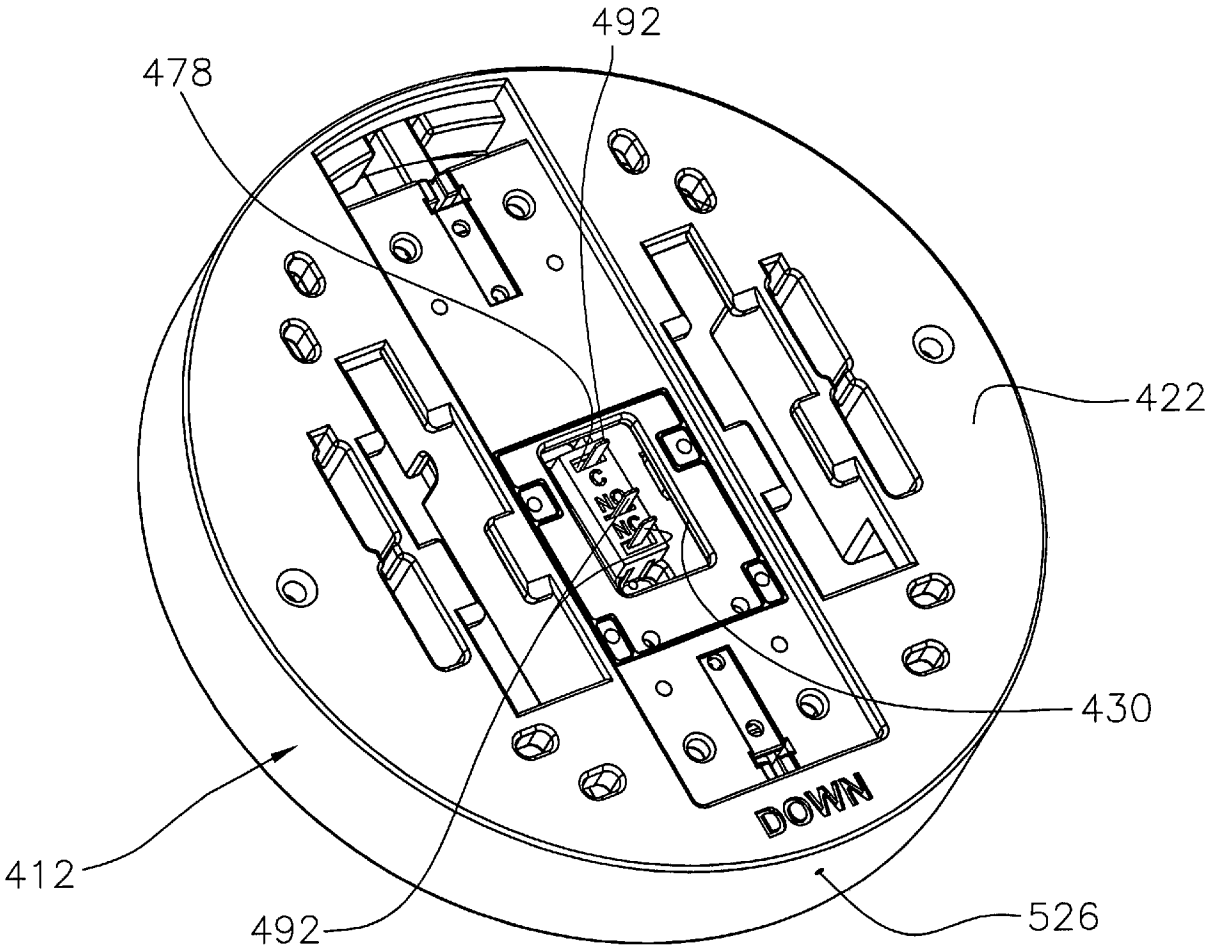
FIG. 30 is a rear isometric view of the assembled push plate assembly of FIG. 28.

As mentioned above, the assembly 410 can be hardwired. With reference to FIG. 24, the mounting plate 414 includes a central opening 458 through which wires can extend. The wires can connect to a switch 478 (FIG. 29) when the rear access door 426 is removed from the housing 412 (FIG. 30). The switch 478 generates a signal that is delivered to the receiver in the door opener. A hard wired assembly will be explained in greater detail below.

Figure 28:
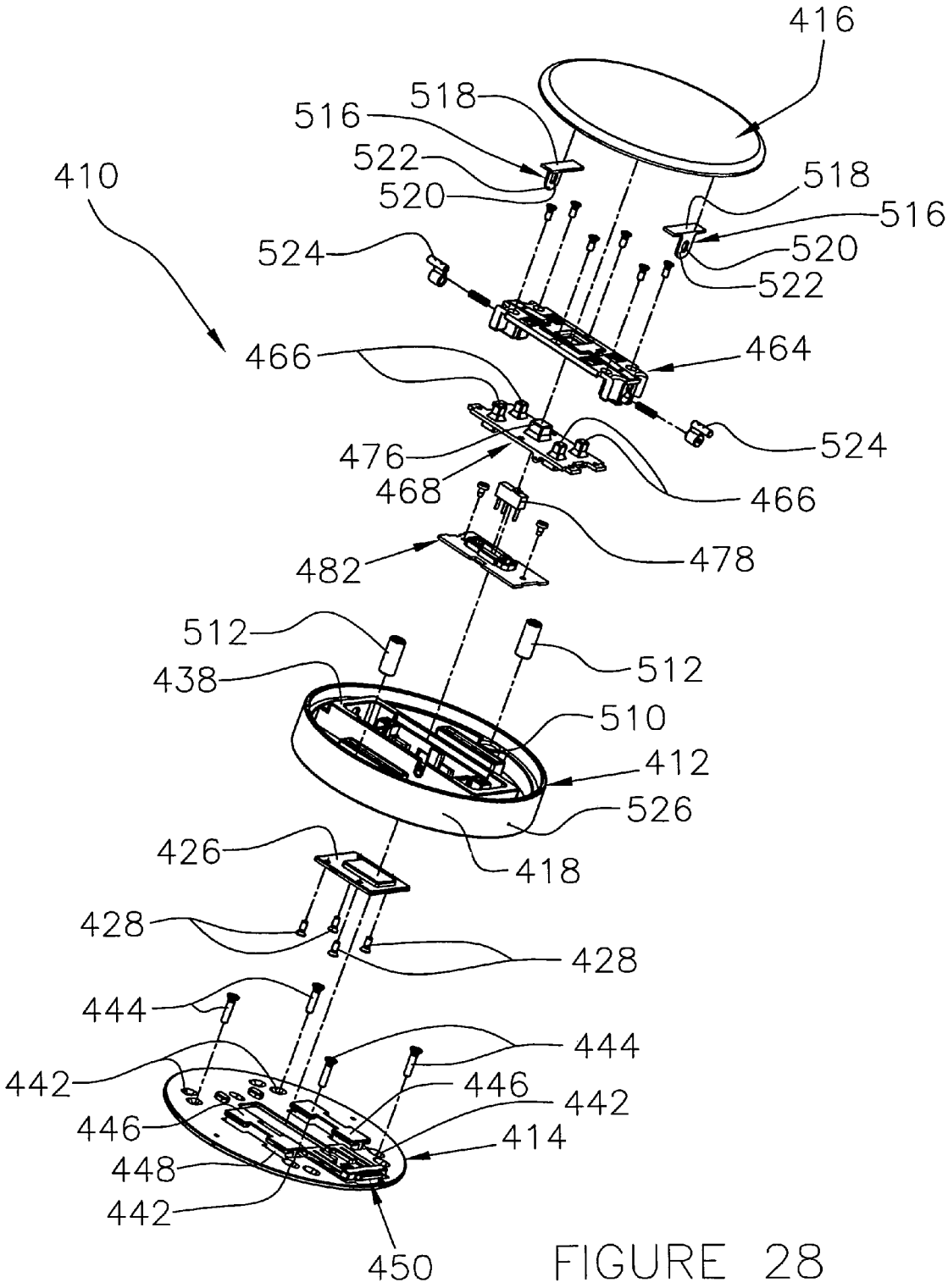
FIG. 28 is an exploded view of the push plate assembly of FIGS. 19 and 27 for use in a hard wired installation.

As best seen in FIGS. 20, 21 and 24, the housing 412 includes the inner rectangular housing portion 438 extending upwardly from the base wall 422 centrally located within the cylindrical side wall 418. The inner housing 438 houses the internal electrical components of the assembly 410, many of which are described in detail above with reference to the other assembly embodiments. As explained above, the push plate assembly 410 can be either a remote transmitting assembly or a hard wired assembly. FIGS. 28-30 disclose internal components in a hardwired assembly and FIG. 31 discloses internal components in a remote transmitting assembly. The housing 412, mounting plate 414 and push plate 416 disclosed in this embodiment of the assembly is designed to accommodate both a hard wired and a remote transmitting assembly.

With reference to FIG. 28, an inner compartment lid 464 attaches to and covers the inner housing 438. Outer buttons 466 extend upwardly from a switch push pad 468 and protrude through the inner compartment lid 464. The outer buttons 466 contact switches 472 on a circuit board 474 (FIG. 31) that communicate with a receiver (not shown) when the assembly is configured as a remote transmission assembly. The inner compartment lid 464, the buttons 466, the switches 472 and the circuit board 474 are all more particularly described above with reference to the aforementioned assembly embodiments.

A large central button 476 also protrudes from the pad 468 through the inner compartment lid 464. With reference to FIG. 28, the large central button 476 contacts a switch 478 for a hardwire unit. As mentioned above, the rear access door 426 is removed to provide access to the circuit board 474 (FIG. 31) and the switch 478 (FIGS. 28 and 30). When the assembly 410 is a radio transmitted assembly the buttons 466 contact switches 472 to activate the circuitry on the circuit board 474 to provide a signal to a remotely positioned receiver. To change the assembly 410 to a hardwire situation, the circuit board 474 and the rear access door 426 are removed and a switch holder 482 and switch 478 are inserted into the inner housing 438 such that the large central button 476 contacts the switch 478 to deliver a signal through a wire (not shown) to the actuator. When the assembly 410 is not hardwired, the central button 476 simply contacts the middle of the circuit board 474 (FIG. 31) and acts as a standoff for the push plate.

With reference to FIG. 29, the switch holder 482 includes two resilient tabs 484 disposed on opposite longitudinal ends of a rectangular opening 486 formed in the switch holder. Each resilient tab 484 is spaced from a rectangular wall 488 that surrounds the rectangular opening 486 and the tabs. The tabs 484 are biased toward the opening 486 so that when the switch 478 is placed into the opening, the resilient tabs engage the switch. The rectangular wall 488 limits movement of the tabs 484 away from the opening 486. The switch holder 482 has the same footprint as the circuit board 474 (FIG. 31) such that fasteners 490 can be used to attach the switch holder 482 and the circuit board 474 in the same location on a mount 480 in the housing, similar to the circuit boards described above. Both the switch holder 482 and the circuit board 474 fit into an inner portion of the inner housing 438 and are protected by the elastomeric push pad 468, similar to the embodiments described above. With the switch 478 positioned in the switch opening 486, terminals 492 of the switch are accessible from the rear of the assembly 410, as seen in FIG. 30, when the rear access door 426 is removed from the housing 412.

Figure 31:
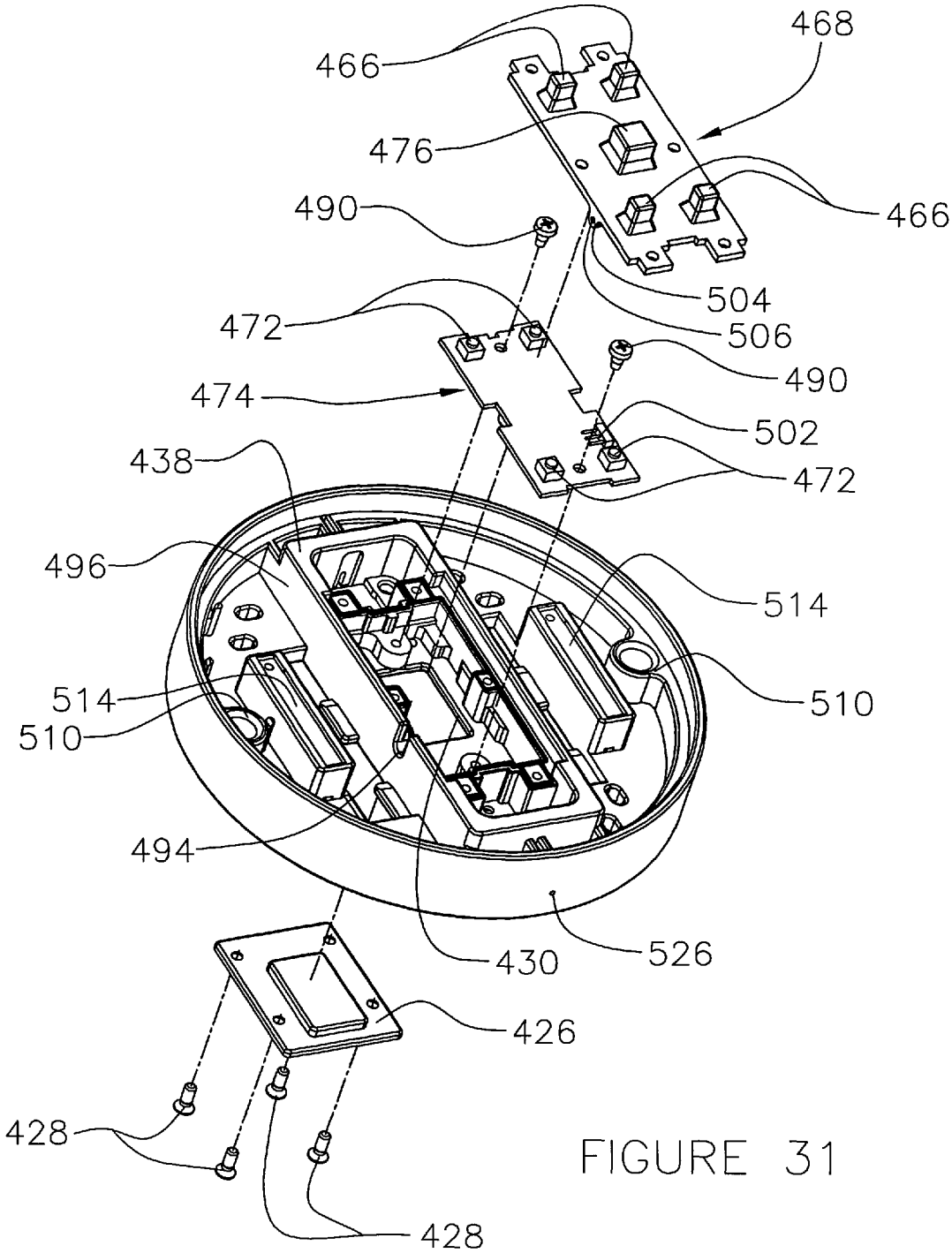
FIG. 31 is an exploded view of the push plate assembly of FIGS. 19 and 27 for use in a remote controlled installation.

As most clearly seen in FIG. 31, a notch 494 is formed in a side wall 496 of the inner housing 438. The notch 494 allows access for a wire antenna 498 to connect to a connector 502 on the circuit board 474 underneath the inner compartment lid 464. The switch pad 468 includes an appendage 504 depending from the pad. The appendage 504 includes an opening 506 having a membrane (not visible), which can be made from the same material as the pad 468, covering the opening. The antenna 498 can pierce the membrane and extend through the opening 506 to connect to the connector 502. When the inner housing lid 464 fastens to the inner housing 438, the lid 464 squeezes the opening 506 around the antenna 498 and seals the opening 506 and opening 494 to and thus the circuit board 474. The opening 506 in the appendage 504 can be sealed even without the antenna protruding through it.

A plurality of antenna holders 508 can be positioned in the housing 412 to hold the antenna. The antenna holders 508 are small posts with resilient fingers that stick up so that the antenna 498 can be trapped between the resilient finger and an adjacent wall or structure in the housing.

The housing 412 also includes a pair of stand-off receptacles 510 positioned on the horizontal axis of the housing 412 adjacent the sidewall 418. The stand-off receptacles 510 receive stand-offs 512 which can be made out of rubber. The stand-offs 512 are about the same height as the buttons 466 and 476 as seen in FIGS. 22 and 23. The stand-offs 512 stabilize the push plate 416. A pair of platforms 514 extend upwardly from the base wall 422 of the housing 412 on opposite sides of the inner housing 438 inward from the stand-off receptacles 510. The platforms 514 can receive a biasing member (not shown), such as a leaf spring, on the top surface to bias the push plate away from the buttons 466 and 476.

Figure 27:
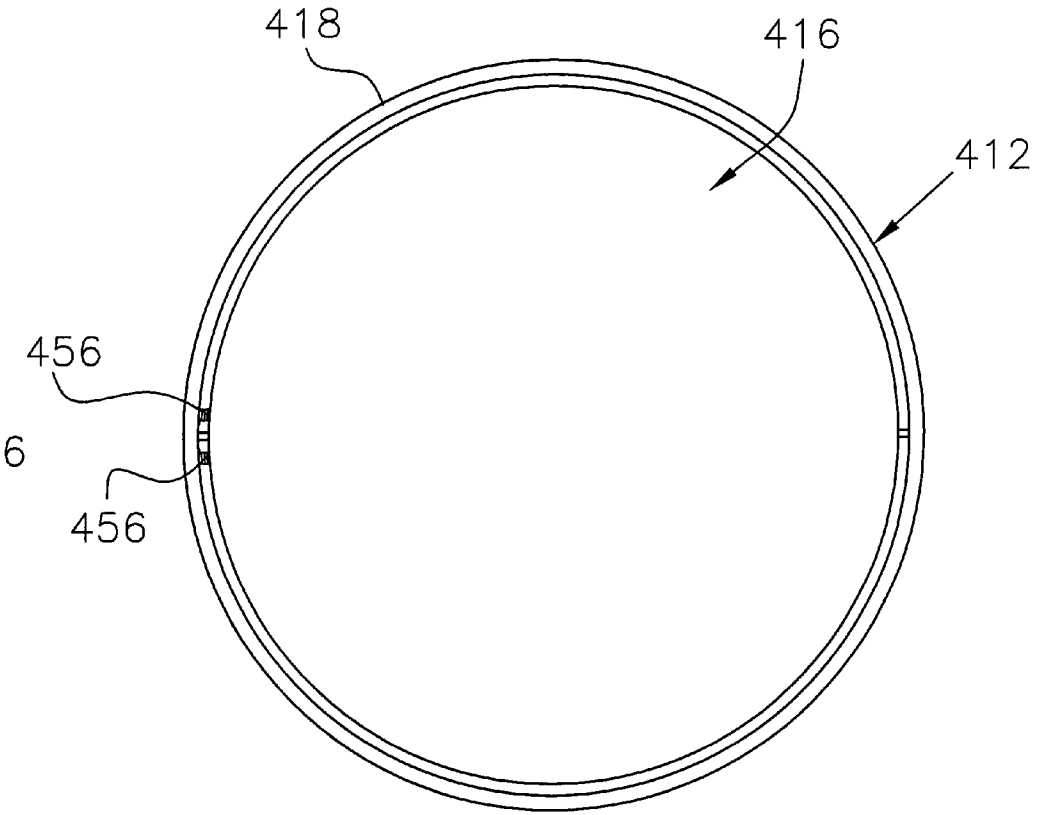
FIG. 27 is a front view of the push plate and push plate assembly of FIG. 26.
Figure 26:
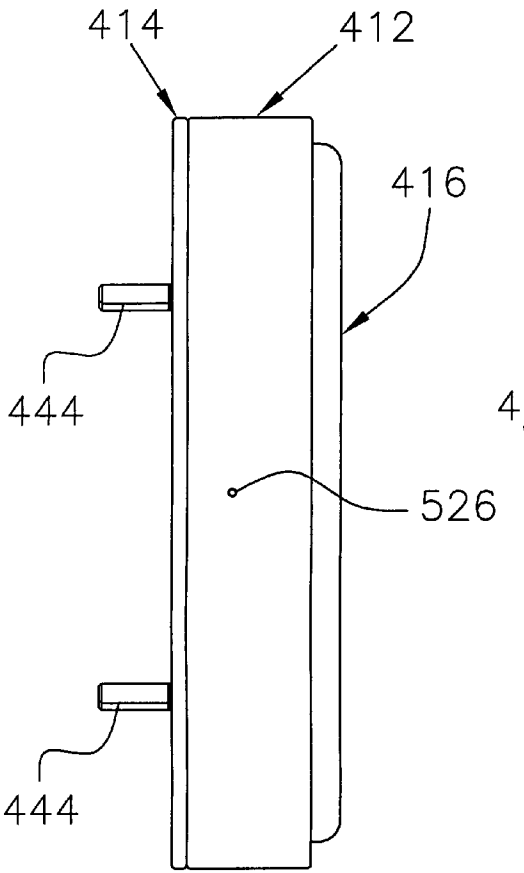
FIG. 26 is a top view of the push plate assembly of FIG. 19 with the push plate mounted to the housing.

The push plate 416 is circular as seen in FIGS. 27 and 28. The push plate 416 mounts to the housing 412 similar to the embodiments described above. The push plate 416 attaches to push plate latch strikes 516 that are generally L-shaped having a push plate mounting surface 518 that attaches to the push plate 416 via spot welding or other conventional methods. The latch strikes form latch elements. Each push plate latch strike 516 includes a latch opening 520 formed through a leg 522 that is at a right angle to the push plate mounting surface 518. The latch opening 520 receives a latch 524 that is received by and biased away from the inner housing lid 464.

As seen in FIGS. 19, 20, 22 and 28, openings 526 are provided in the side wall 418 of the housing 412 to engage the latch 524 and to bias the latch 524 away from the inner housing 438. Pushing the latch 524 inward toward the center of the housing 412 allows for the push plate 416 to be removed from the housing 412. With reference to FIG. 27, the periphery of the push plate 416 is spaced from the cylindrical side wall 418 of the housing 412. This allows a tool, such as a screwdriver, to be inserted between the push plate 416 and the housing 412 to engage the knurl 456 to allow for removal of the housing 412 from the mounting plate 414.

A push plate assembly according to the above-described embodiment allows the housing 412 to be removed from the mounting plate 414 with little displacement of one piece in relation to the other. In other words the attachment and detachment of the housing 412 and mounting plate 414 can be described as "short stroke." This allows for the housing 412 to be easily removed from the mounting plate 414 when the assembly 410 is hard wired. The short stroke detachment facilitates removal and avoids entanglement of the wires. The mounting plate 414 also has a large area to accommodate surface irregularities on the surface to which the assembly mounts.

Figure 32:
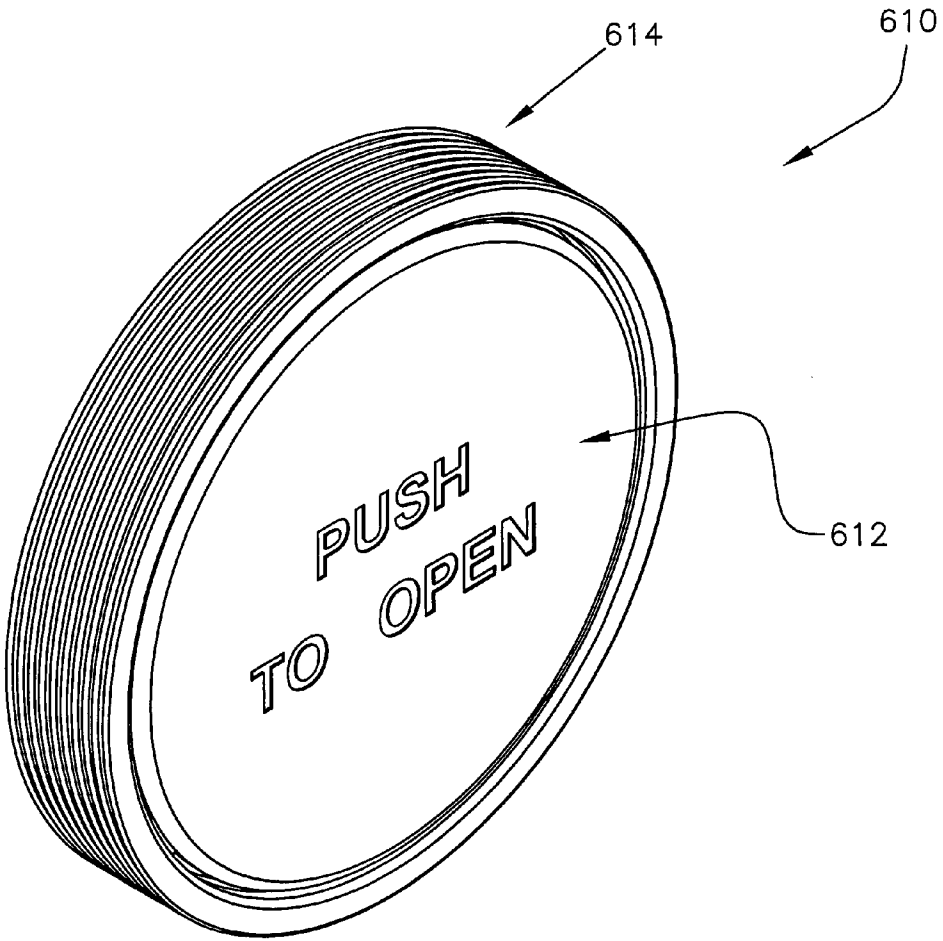
FIG. 32 is a perspective of a fifth embodiment of a push plate assembly.

With reference to FIG. 32, another embodiment of a push plate assembly 610 generally includes a push plate 612 movably mounted in a housing assembly 614 that will be described in more detail below. The push plate assembly 610 can be a wireless unit, which is depicted in FIG. 33, or the push plate assembly 610 can be a hard-wired unit, which is depicted in FIG. 34.

Figure 33:
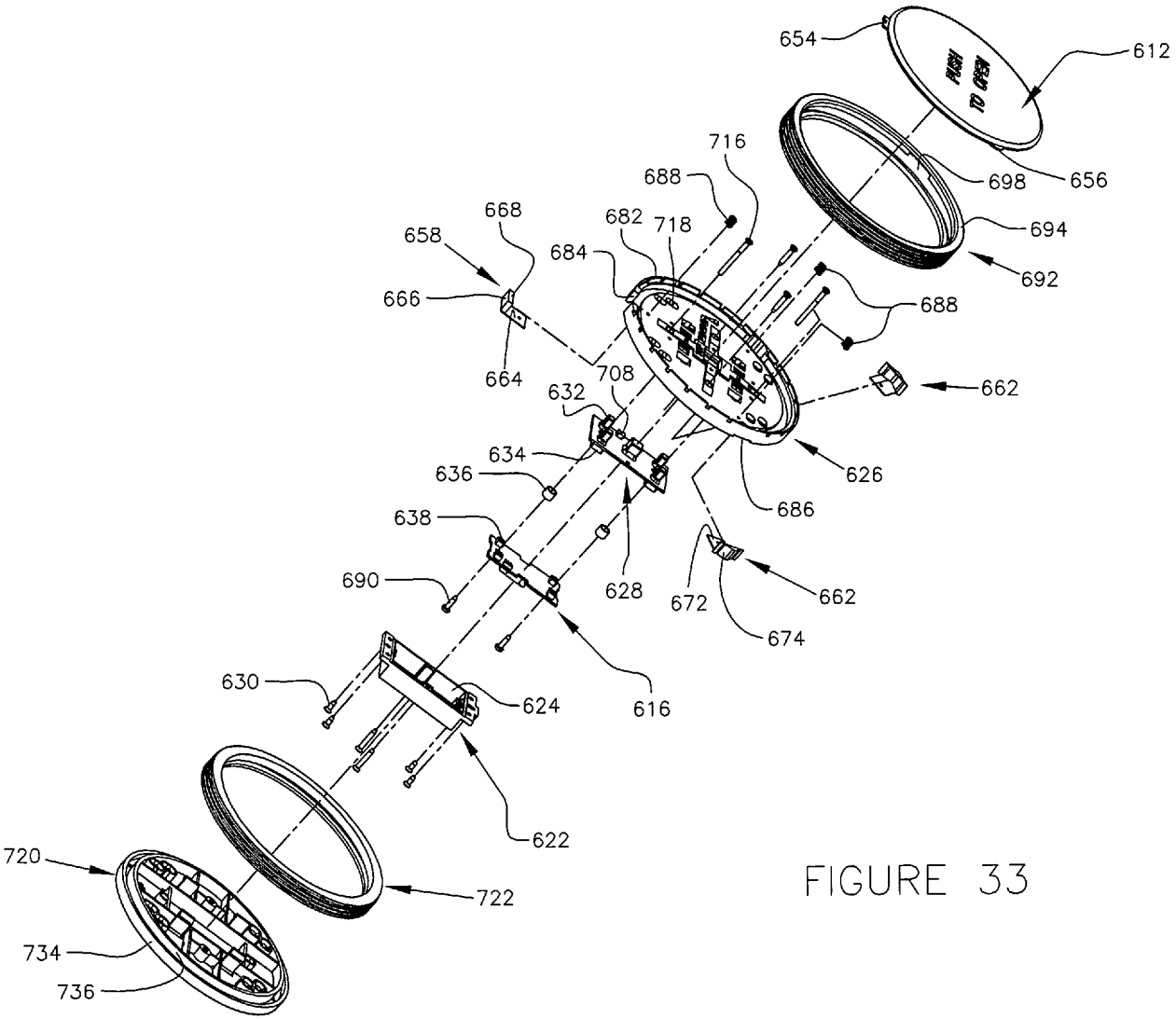
FIG. 33 is an exploded view of the push plate assembly of FIG. 32 configured as a wireless unit.
Figure 34:
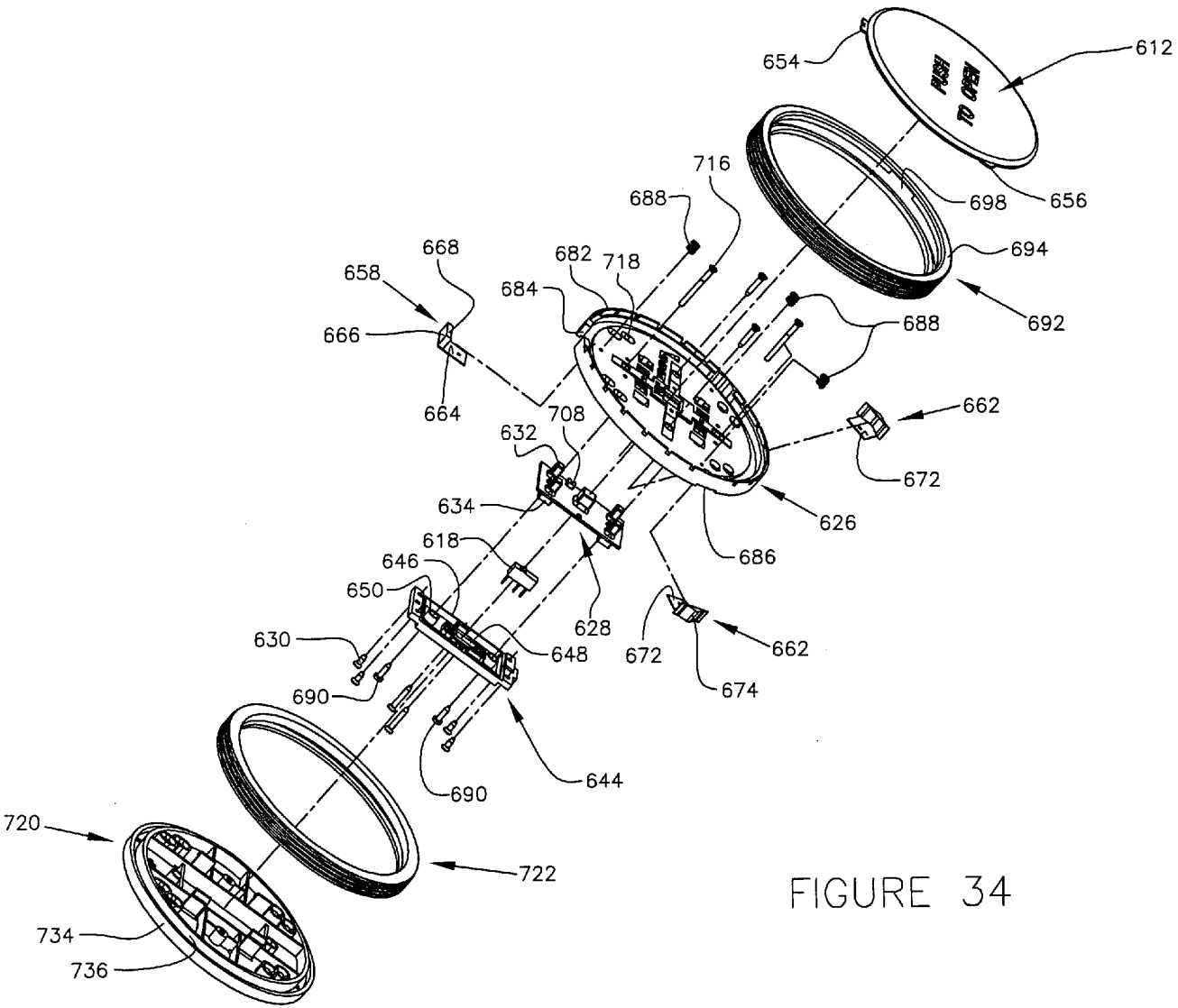
FIG. 34 is an exploded view of the push plate assembly of FIG. 32 configured as a hard-wired unit.

Similar to the embodiments described above, the push plate 612 selectively actuates a signal generator, which is shown as a circuit board 616 in FIG. 33, and which is shown as a switch 618 in FIG. 34. The circuit board 616 and the switch 618 are similar to those described with reference to the aforementioned embodiments, and therefore will not be described further.

With reference to FIG. 33, the circuit board 616 is disposed in a housing 622 that includes a forward opening 624 to receive the circuit board 616. The circuit board housing 622 is configured to be received inside a single gange box that is conventionally used in construction. Such electrical gange boxes are known and have somewhat standard dimensions.

Allowing the circuit board housing 622 to fit inside an electrical gange box allows for a thinner overall design for the push plate assembly 610 when it is mounted to a wall or similar structure as compared to conventional push plate designs.

With continued reference to FIG. 33, a circular plate-like member 626 attaches to the circuit board housing 622 to cover the forward opening 624 so that the circuit board 616 is enclosed. A plurality of fasteners 630 connect the printed circuit board housing 622 to the circular plate 626. In the embodiment depicted in FIG. 33, a switch push pad 628 is interposed between the circular plate 626 and the printed circuit board housing 622. Similar to the push pads described above, the switch push pad 628 can be made from a waterproof membrane and includes a plurality of upwardly extending buttons 632, a plurality of downwardly extending standoffs 634, one standoff for each button. The switch push pad 628 seals the forward opening 624 of the printed circuit board housing 622 to protect the circuit board 616 from the elements. Additional standoffs 636 can be provided at opposite longitudinal ends of the circuit board 616 to appropriately space the buttons 632 of the switch push pad 628 from switches 638 on the printed circuit board 616, so that when the circuit board housing 622 attaches to the circular plate 626 the buttons do not inadvertently contact the switches.

Figure 35:
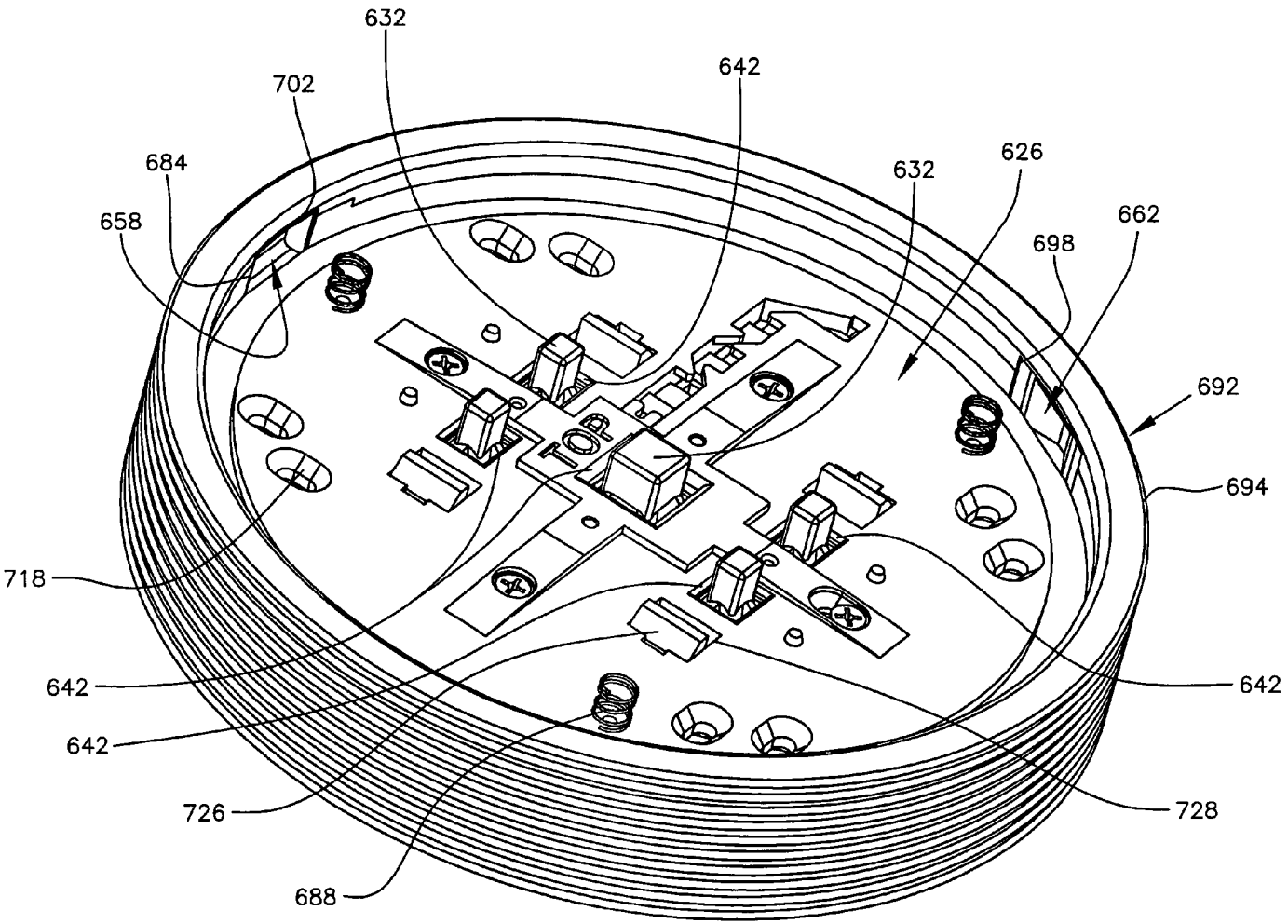
FIG. 35 is a perspective assembled view of the push plate assembly of FIG. 32 with a push plate removed from the assembly.

With reference to FIG. 35, the circular plate 626 includes a plurality of button openings 642 through which the respective buttons 632 protrude. It is the buttons 632 that are contacted by the push plate 612 that activates the signal generator, either circuit board 616 or the switch 618.

With reference to FIG. 34, instead of the printed circuit board housing 622, a switch holder 644 attaches to the circular plate 626. The switch holder 644, similar to the printed circuit board housing 622, is dimensioned to be received inside a conventional electrical gange box. The switch holder 644 has a forward opening 646 and the switch push pad 628 is interposed between the circular plate 626 and the switch holder 644 to cover the forward opening 646. The switch holder also includes a central opening 648 that receives the switch 618. The central opening 648 allows for access to the contacts of the switch 618 so that the push plate assembly can be used as a hard wired unit. The switch holder 644 attaches to the circular plate 626 via a plurality of fasteners 630. The switch holder 644 can also include bosses 650 that act as standoffs.

Figure 36:
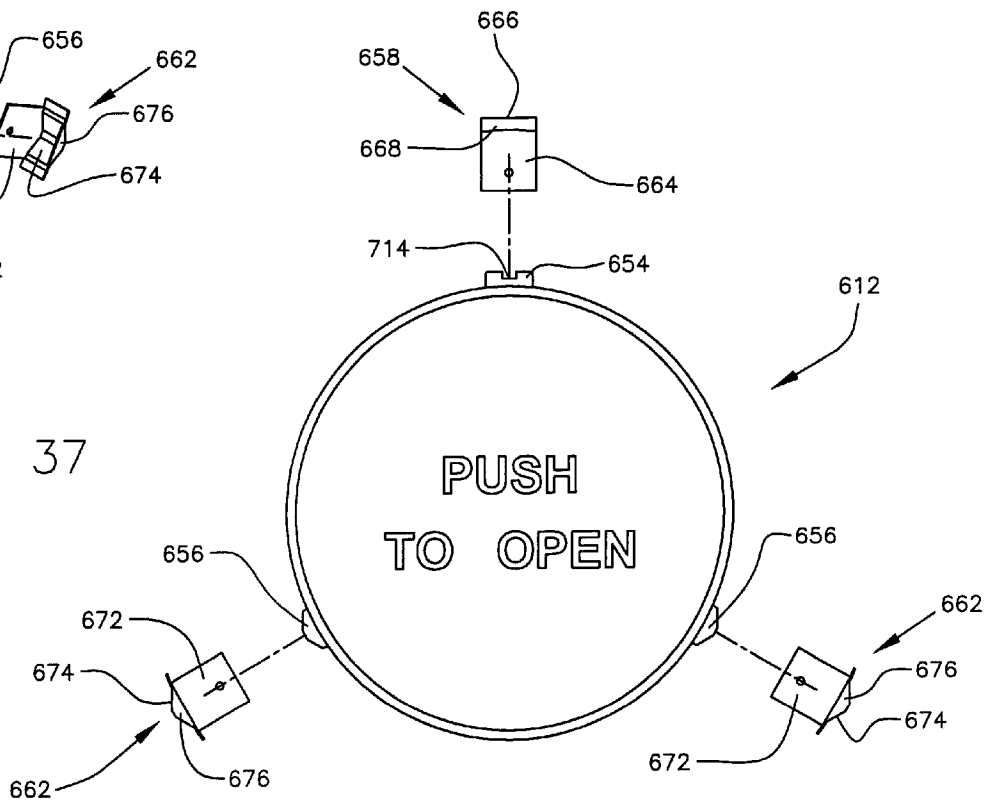
FIG. 36 is a front view of the push plate of the push plate assembly of FIG. 32 and clips for retaining the push plate.
Figure 37:
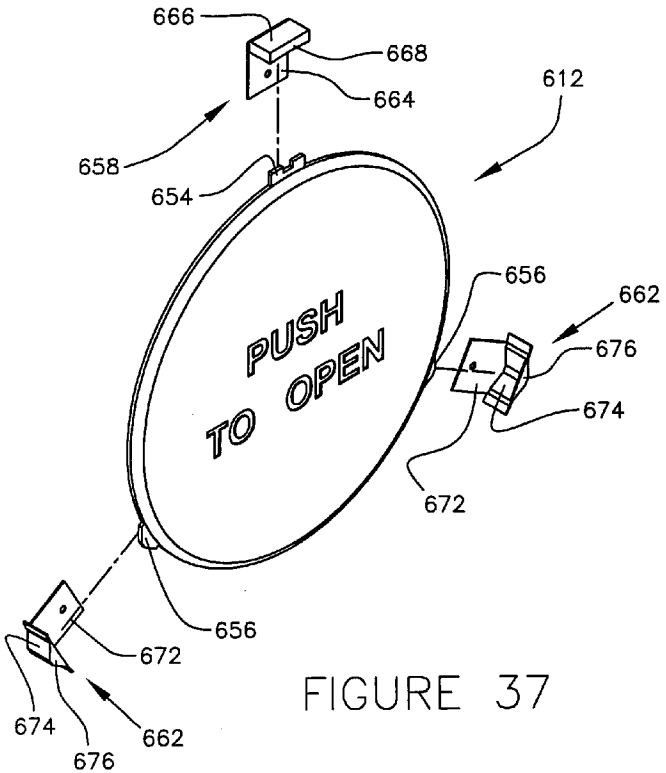
FIG. 37 is a perspective view of the push plate and clips depicted in FIG. 36.

With reference to FIG. 36, the push plate 612 includes an upper tab 654 that extends from a peripheral edge of the push plate. Lower tabs 656 also extend from the peripheral edge of the push plate 612. The upper tab 654 and the lower tabs 656 can be referred to as latch elements since they are used to retain the push plate. The upper tab 654 engages an upper clip 658 that retains the push plate 612 in a desired spaced relationship with the circular plate 626. The lower tabs 656 engage lower clips 662 that also retain the push plate 612 in a desired spaced relationship from the circular plate 626.

Figure 38:
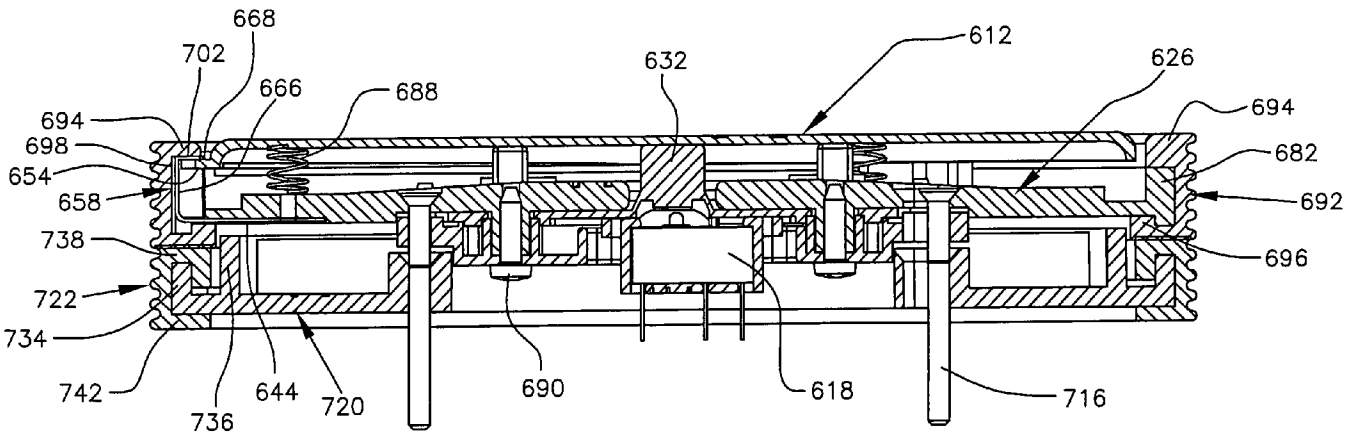
FIG. 38 is a cross-sectional view of the push plate assembly of FIG. 32 configured for a hard-wired unit.
Figure 39:
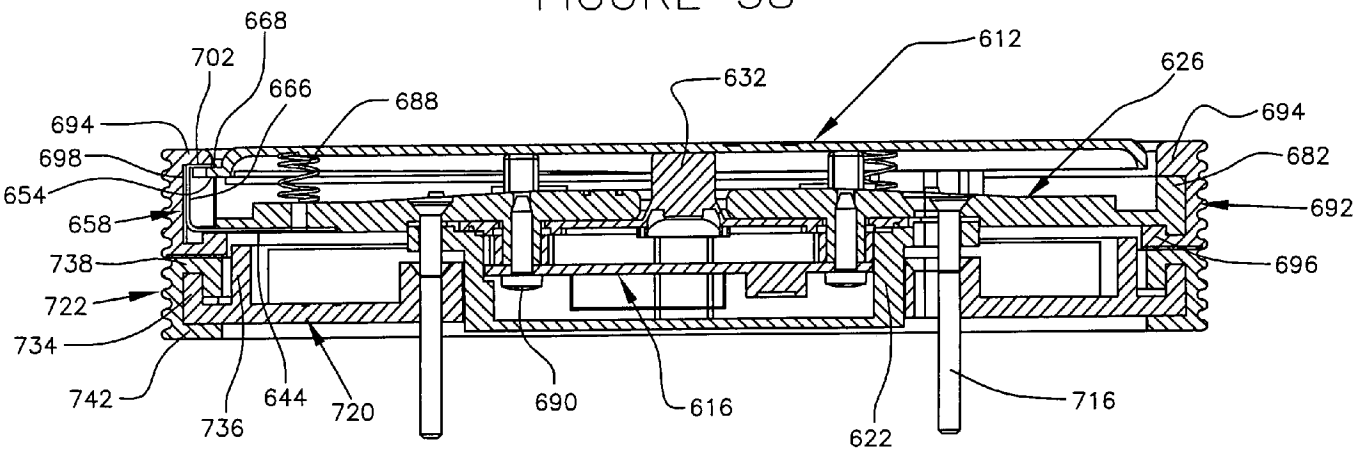
FIG. 39 is a cross-sectional view of the push plate assembly of FIG. 32 configured for a wireless unit.

As more clearly seen in FIGS. 38 and 39, the upper clip 658 includes a first leg 664 that attaches to a rear surface of the circular plate 626. The upper clip 658 also includes a second leg 666 that is perpendicular to the first leg and extends from the first leg the distance that the push plate 612 is normally spaced from the circular plate 626 when no force is being exerted on an outer surface of the push plate. The upper clip 658 also includes a retaining ledge 668 that is parallel to the first leg 664 and extends at a right angle to the second leg 666. The retaining ledge 668 contacts the upper tab 654 to retain the push plate 612.

Each lower clip 662 includes a first leg 672 that attaches to the lower surface of the circular plate 626 (FIGS. 33 and 34). Each lower clip also includes a second leg 674 that extends perpendicularly from the first leg 672 the same distance as the second leg 666 of the upper clip 658. The second leg 674 is angled and/or curved so that an upper portion, i.e. a portion of the leg nearer the upper clip 658, of the second leg is positioned in a substantially vertical orientation when the push plate assembly 610 is assembled and attached to a wall or other mounting structure. Such an orientation allows for easy removal of the push plate 612 from the rest of the push plate assembly. Removal of the push plate 612 will be described in more detail below. Each lower clip 662 also includes a retaining ledge 676 that is similar to the retaining ledge 668 for the upper clip 658.

Figure 40:
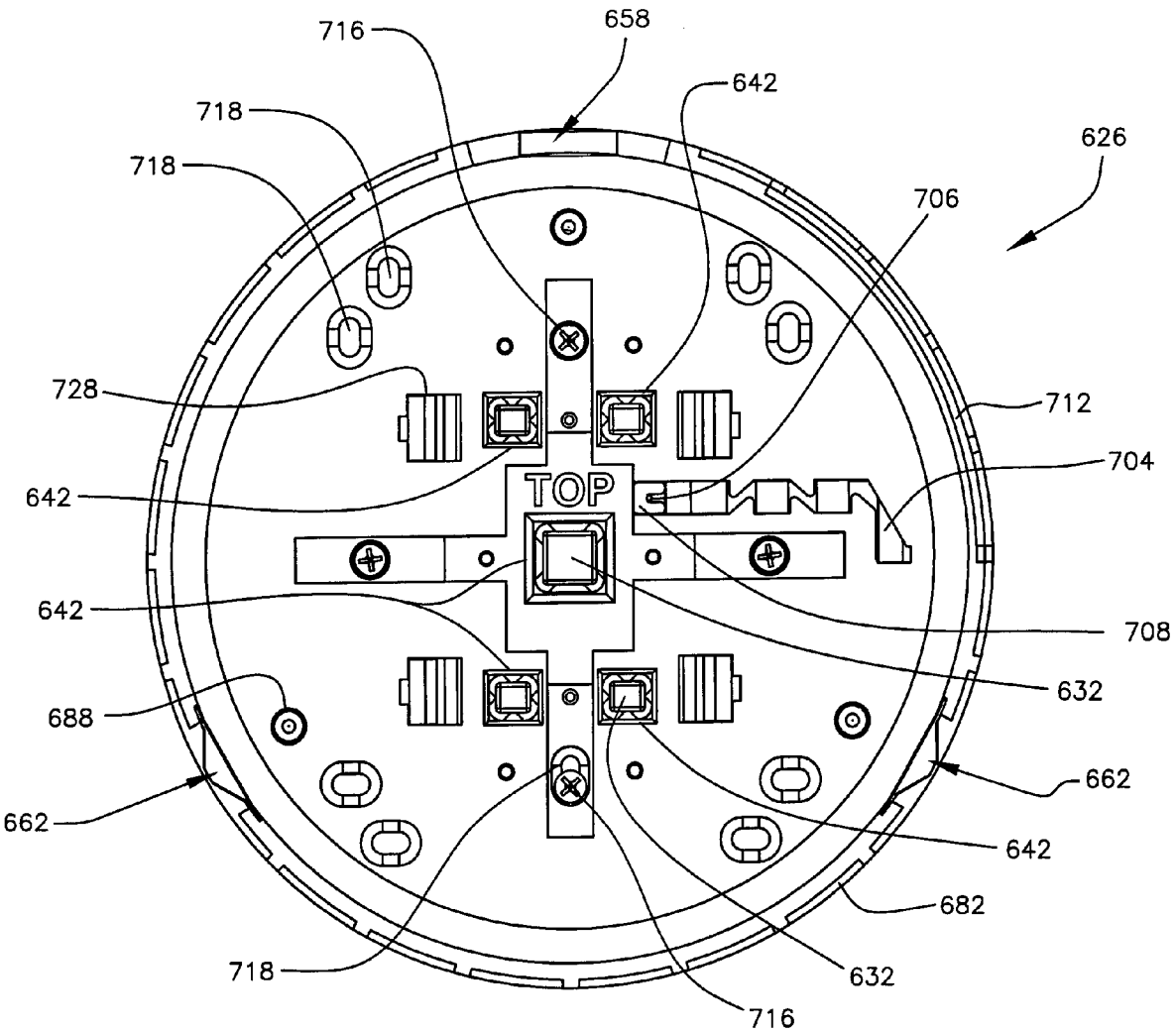
FIG. 40 is a plan view of a forward plate of the push plate assembly of FIG. 32.

With reference back to FIG. 33 or 34, the circular plate 626 includes a circular side wall 682 that extends from a peripheral edge of the plate 626 towards the push plate 612. The circular side wall 682 is interrupted at the top to form a notch 684 that receives the upper clip 658 (FIG. 40). Two openings 686 are formed at the intersection of the circular side wall 682 and the plate 626 (only one visible in FIGS. 33 and 34) spaced about 120° around the circular sidewall 682 from the upper notch 684. The second leg 674 of each lower retaining clip 662 extends up through each opening 686 to reside against an inner surface of the circular side wall 682 (FIG. 40). When fastening the clips 658 and 662 to the circular plate 626, springs 688 can also be fastened to the circular plate 626 at the same time the respective clips are fastened. The springs 688 can act as biasing members to bias the push plate 612 away from the circular plate 626 and the signal generator.

An annular boot 692 is fitted around the circular side wall 682 of the circular plate 626. The annular boot 692 can be made from any resilient material including, natural rubber, synthetic rubber and other resilient materials. As more clearly seen in FIGS. 38 and 39, the annular boot 692 includes an inwardly extending upper ledge 694 that fits over the circular side wall 682 of the circular plate 626 and an inwardly extending lower ledge 696 that fits underneath the circular plate 626. Therefore, the entire circular wall 682 of the circular plate 626 can be surrounded by the boot 692. If desired, the upper ledge 694 of the boot can contact the push plate 612 to bias the push plate away from the buttons 632. The annular boot includes notches 698 formed in the upper ledge 694 that align with the openings 686 that receive the lower clips 662 (only one lower notch is visible in FIGS. 33, 34 and 35). With reference to FIGS. 35, 38 and 39, the boot 692 also includes a notch 702 for receiving the upper clip 658. This is more easily visible when comparing the upper ledge 694 on the left side of FIGS. 38 and 39 as compared to the upper ledge 694 on the right side of FIGS. 38 and 39. The notches 698 and 702 formed in the annular boot 692 allow the peripheral edge of the push plate 612 to reside below the upper ledge 694 of the annular boot 692.

With reference to FIG. 40, the circular plate 626 is shown prior to the boot 692 being installed around the outer wall 682. The circular plate 626 includes an antenna retaining slot 704 into which an antenna that is connected to the circuit board 616 can reside. The circular plate 626 includes an antenna opening 706 through which protrudes an antenna seal 708 that is attached to the switch push pad 628 (FIGS. 33 and 34). The antenna seal 708 can be made from the same material as the switch push pad 628. The antenna (not shown) can pierce through the antenna seal 708 and then be retained inside the antenna retaining slot 704. A second antenna retaining slot 712 is provided adjacent the circular outer wall 682 of the circular plate 626 and is connected to the first antenna retaining slot 704. The second antenna retaining slot 712 runs along the circular outer wall 682. By positioning the second antenna slot 712 near the outer side wall 682 of the circular plate 626 the antenna is positioned near or externally from a peripheral edge of the metal push plate 612 so that the push plate does not interfere with the signal being transmitted by the antenna as much as if the antenna terminated near the center of the housing. Accordingly, a signal can be sent to a receiver that is at a greater distance from the push plate assembly 610 as compared to a device where the antenna is interposed between a metal push plate and the wall to which the assembly mounts. To cover the antenna (not shown) the upper ledge 694 (FIGS. 38 and 39) of the boot 692 is placed overtop the outer wall 682 of the circular plate 626.

To assemble the push plate assembly depicted in FIG. 33, fasteners 690 are inserted through openings (not visible) in the printed circuit board 616, through the standoffs 636, through openings (not visible) in the switch push pad 628 and into openings in the plate 626. The switch push pad 628 is aligned so that the buttons 632 extend through button openings in the circular plate 626 and the buttons align with the switches 638. The circuit board housing 622 is then fastened to the circular plate 626 using fasteners 630.

To assemble the embodiment depicted in FIG. 34, the switch 618 is inserted into the central opening 648 of the switch holder 644. The switch push pad 628 is positioned over the switch 618 so that the central button 632 on the switch push pad 628 aligns with the switch 618. The switch holder 644 is then fastened using fasteners 630 to the circular plate 626 sandwiching the switch push pad 628 between the switch holder 644 and the circular plate 626. The remainder of the assembly procedure is the same for both the hard-wired unit and the wireless unit. The interchangeability of the components saves in manufacturing costs.

The retaining clips 658 and 662 are attached to the circular plate 626 at the same time the springs 688 are attached to the circular plate. The circular plate-626 is inserted into the annular boot 692 such that the lower clips 662 fit into the notches 698 and the upper clip 658 fits into the notch 702 (FIGS. 35, 38 and 39). The push plate 612 is then inserted into the annular boot 692 such that the lower tabs 656 are caught underneath the retaining ledge 676 of each retaining clip 662. The portion of the upper ledge 694 of the boot 692 above the upper retaining clip 658 is then pushed back with the retaining ledge 668 so that the upper tab 654 of the push plate 612 can fit underneath the retaining ledge 668 of the upper clip 658. The biasing members 688 bias the push plate 612 from the buttons 632 of the switch push pad 628. No adjustment is required to adjust the height at which the push plate 612 stands off of the buttons 632.

To remove the push plate 612 from the assembly, the upper ledge 694 of the boot 692 and the retaining ledge 668 of the upper clip 658 are pushed back. As more clearly seen in FIG. 36, the upper tab 654 on the push plate 612 includes a notch 714 that is dimensioned to receive a screwdriver. A screwdriver is inserted into the notch 714 so that the push plate 612 can be pried away from the retaining clip 658. The push plate 612 is then slid vertically upward and out of the upper clip 658 and the annular boot 692. The lower tabs 656 and the lower clips 662 are configured to allow the push plate 612 to be slid vertically upward and out of annular boot 692. The upper portion of second leg 674 of each lower clip 662 is vertically oriented when the assembly 610 is mounted to a wall. The lower portion second leg 674 of each lower clip 662 is also sloped downward so that if any rain or other debris gets behind the push plate 612, the rain or debris can run out of the retaining clip 662 when the assembly 610 is mounted to a wall or other structure.

The circular plate 626 can mount to a wall or other structure via fasteners 716 that are received through mounting openings 718. The mounting openings 718 are appropriately spaced so that they can be received by openings found in standard electrical gange boxes. The inner mounting openings, i.e. the mounting openings closer to a vertical center line of the circular plate 626 as shown in FIG. 40, are positioned to align with fastener openings in a conventional single gange box. The outer fastener openings are positioned to align with openings located in a double gange box, or larger.

Where a gange box is not provided a lower mounting plate 720 can selectively fasten to the circular plate 626. In describing the remainder of the embodiment (both the wireless unit depicted in FIG. 33 and the hard-wired unit depicted in FIG. 34), the circular plate 626 will be referred to as the forward plate and the circular plate 720 will be referred to as the rearward plate. A rearward annular boot 722, which is similar to the forward annular boot 692, is disposed around a peripheral edge of the rearward circular plate 720.

Figure 41:
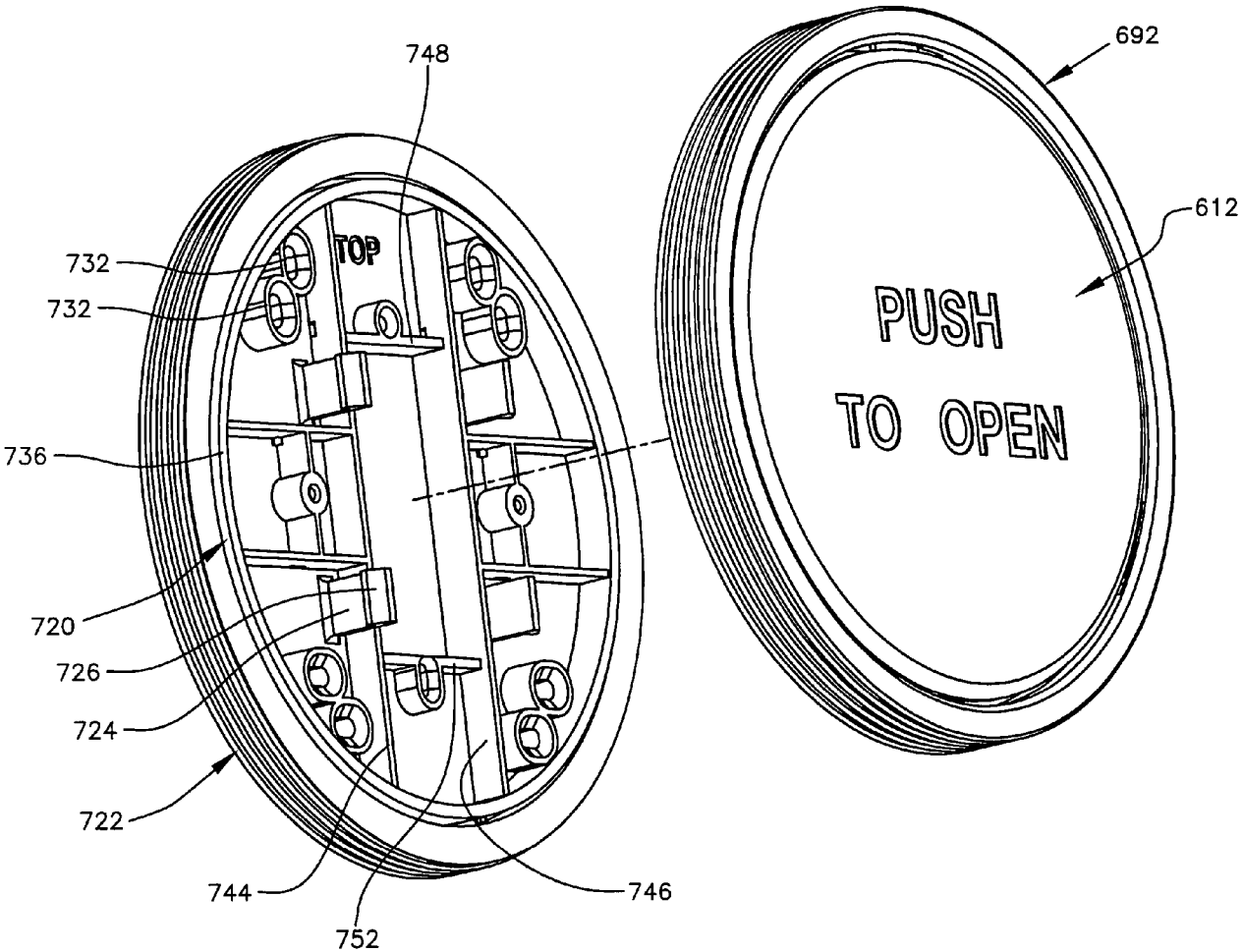
FIG. 41 is a perspective view of a first portion of the push plate assembly of FIG. 32 removed from a second portion.

With reference to FIG. 41, the rearward circular plate 720 includes four resilient mounting clips 724 each having a barb 726 disposed at a distal end. The resilient mounting clips 724 form a latch element for securing the rearward circular plate 720 to the forward circular plate 626. With reference to FIG. 35, the forward plate 626 includes four mounting openings 728 that are appropriately positioned on the circular plate 626 and shaped to receive the barbs 726 of the rearward plate 720. A snap-on connection is provided between the forward plate 626 and the rearward plate 720.

With reference back to FIG. 41, the lower plate 720 includes a plurality of mounting bosses 732 that align with the mounting openings 718 in the forward plate 626 when the forward plate is attached to the rearward plate 720. Accordingly, the mounting bosses 732 have openings that align with openings in a standard electrical gange box so that the rearward plate 720 can be mounted to a gange box. With such a configuration, the rearward plate 720 can be mounted to a gange box or other structure and the upper portion of the assembly, i.e. the forward plate, and the components connected thereto, can snap-on to the rearward plate 720 for an easy connection.

The rearward plate 720 also includes two concentric circular outer walls, a first outer wall 734 (FIGS. 33 and 34) extends upwardly from a peripheral edge of the rearward plate 720 and a second circular wall 736 is spaced radially inwardly from the outer circular wall. With reference to FIGS. 38 and 39, the rearward annular boot 722 fits around the outer circular wall 734. The upper ledge 738 has an L-shaped configuration so that it includes a portion interposed between the outer wall 734 and the inner wall 736 when the boot 722 is positioned around the rearward plate 720. The annular boot 722 includes an upper ledge 738 that extends over an upper ledge of the outer circular wall 734. The annular boot 722 also includes a lower ledge 742 that fits underneath or behind the outer wall 734 and the rearward circular plate 720. With continued reference to FIG. 38, when the forward plate 626 attaches to the rearward plate 720, the lower ledge 696 of the forward annular boot 692 presses against the upper ledge 738 of the rearward boot 722 forming a water tight seal between the two. The annular corrugations on the respective boots 692 and 722 align with one another so that when assembled, the forward boot 692 and the rearward boot 722 appear to be made from a single piece of rubber, or other material.

With reference to FIG. 41, vertical internal walls 744 and 746 extend towards the forward plate 626 and are laterally spaced from one another a distance about equal to the width of the printed circuit board housing 622 or the switch holder 644. First and second inner horizontal walls 748 and 752 extend upwardly from the rearward plate 720 the same distance that the first and second vertical walls 744 and 746 extend from the rearward plate 720. The first and second horizontal walls 748 and 752 are spaced from one another a distance that is approximately equivalent to the height of the printed circuit board housing 622 or the switch holder 644. Accordingly, the printed circuit board housing 622 or the switch holder 644 can fit in between the respective walls 744, 746, 748 and 752 when the upper plate 626 attaches to the lower plate 720.

Other cavities are defined between the inner walls 744, 746, 748 and 752 and the inner circular wall 736. Items such as a power source and/or light source can be provided in these cavities. The boots 722 and 692 and the rearward plate 720 and the upper plate 626 can be made from a translucent material so that the assembly 610 can be lit.

Figure 42:
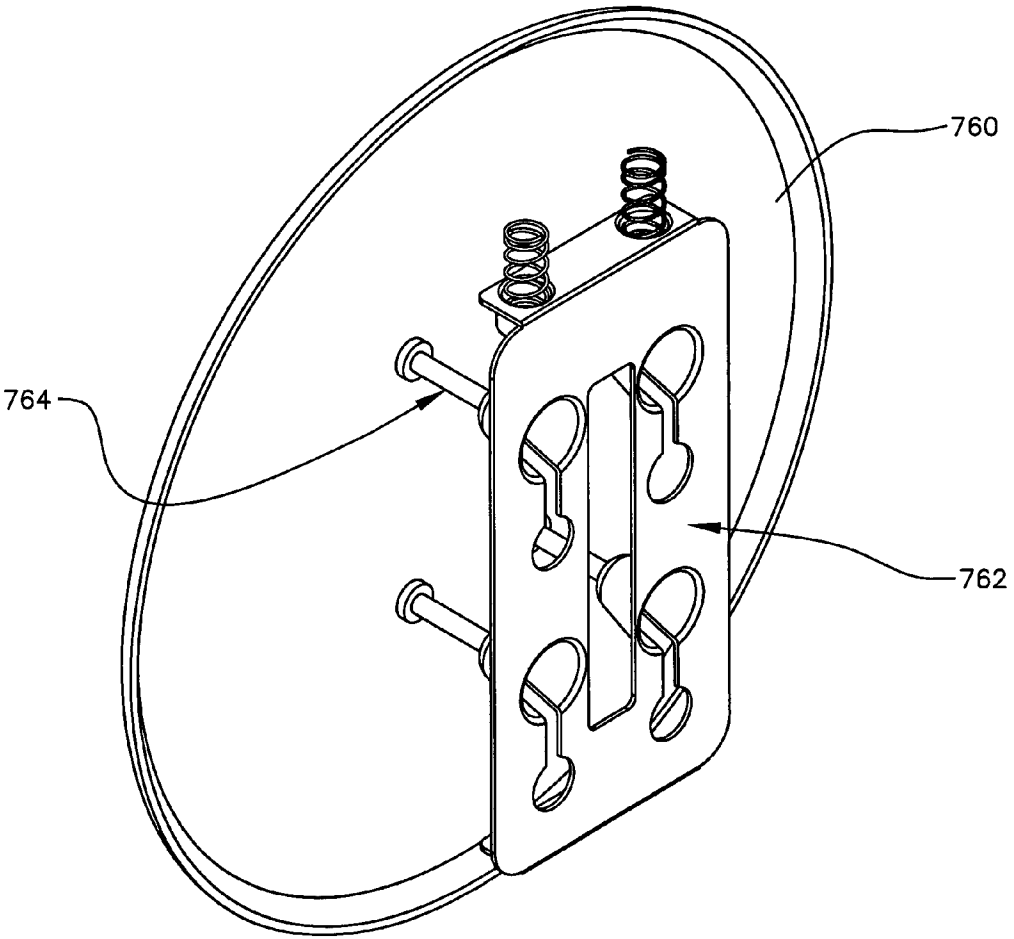
FIG. 42 is a rear perspective view of a push plate and mounting assembly for the push plate for use in a push plate assembly.
Figure 43:
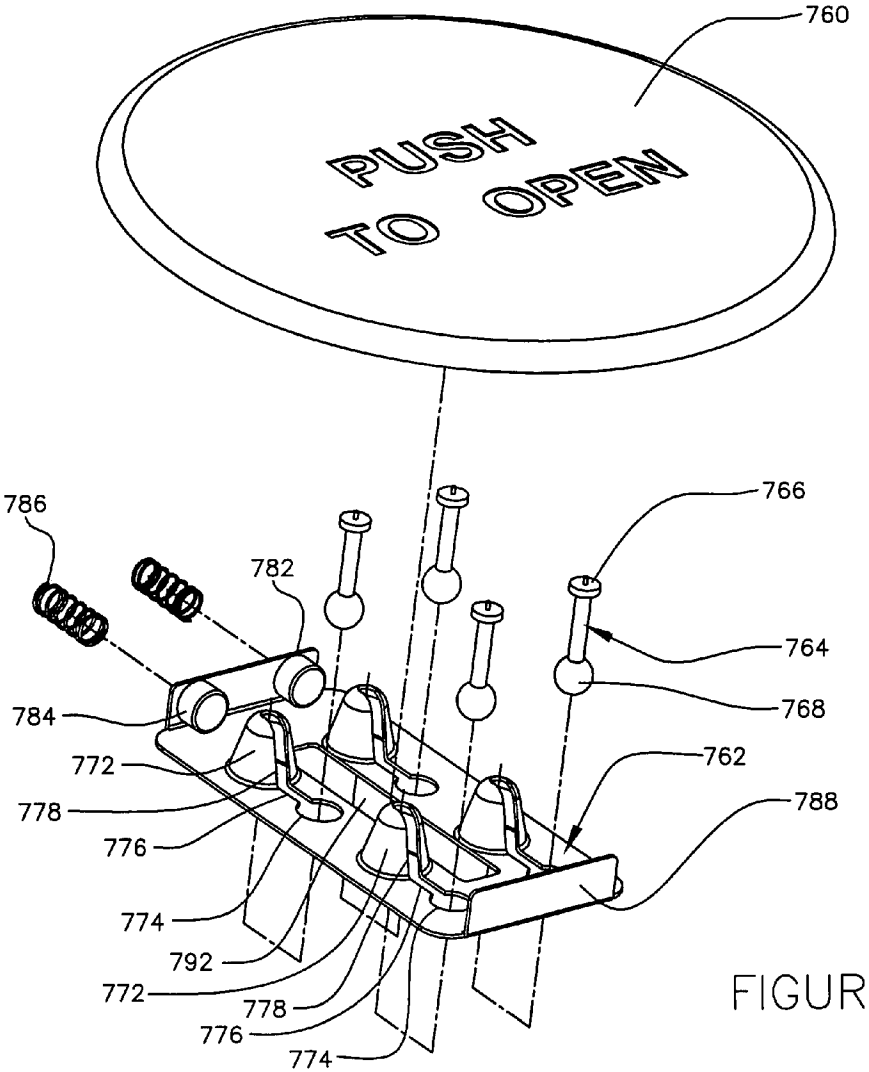
FIG. 43 is an exploded view of the assembly shown in FIG. 42.

With reference to FIG. 42, an alternative manner in which a push plate can be mounted in a push plate assembly is disclosed. The mounting configuration disclosed can be used in any of the push plate assemblies that have been described above and can also be used in known push plate assemblies. In FIG. 42, a push plate 760 connects to a retaining plate 762 via a plurality of studs 764. As with the other embodiments described above, the push plate 760 can take other configurations such as a convex button and the like. With reference to FIG. 43, each stud 764 includes a head 766 that attaches to a rear surface of the push plate 760. Each stud 764 also includes a ball 768 disposed in an opposite end of the stud 764 from the head 766.

A plurality of sockets 772 extend from the retaining plate 762 towards the push plate 760. The sockets 772 are configured to receive the balls 768 of the studs 764. Accordingly, the studs 764 and the sockets 772 and/or the retaining plate 762 can each be referred to as a latch element. Circular openings 774 are formed in the retaining plate 762 and are dimensioned such that the balls 768 can extend through the ball openings. A slot 776 extends from each ball opening 774 towards each socket 772. The slot 776 is dimensioned such that the stud 764 can move freely in the slot, but the slot does not allow the ball 768 to extend through. A slot 778 is also formed in each socket 772 that extends from the slot 776. The slot 778 in the socket 772 also allows the stud 764 to extend through, but does not allow the ball 768 to extend through.

Figure 44:
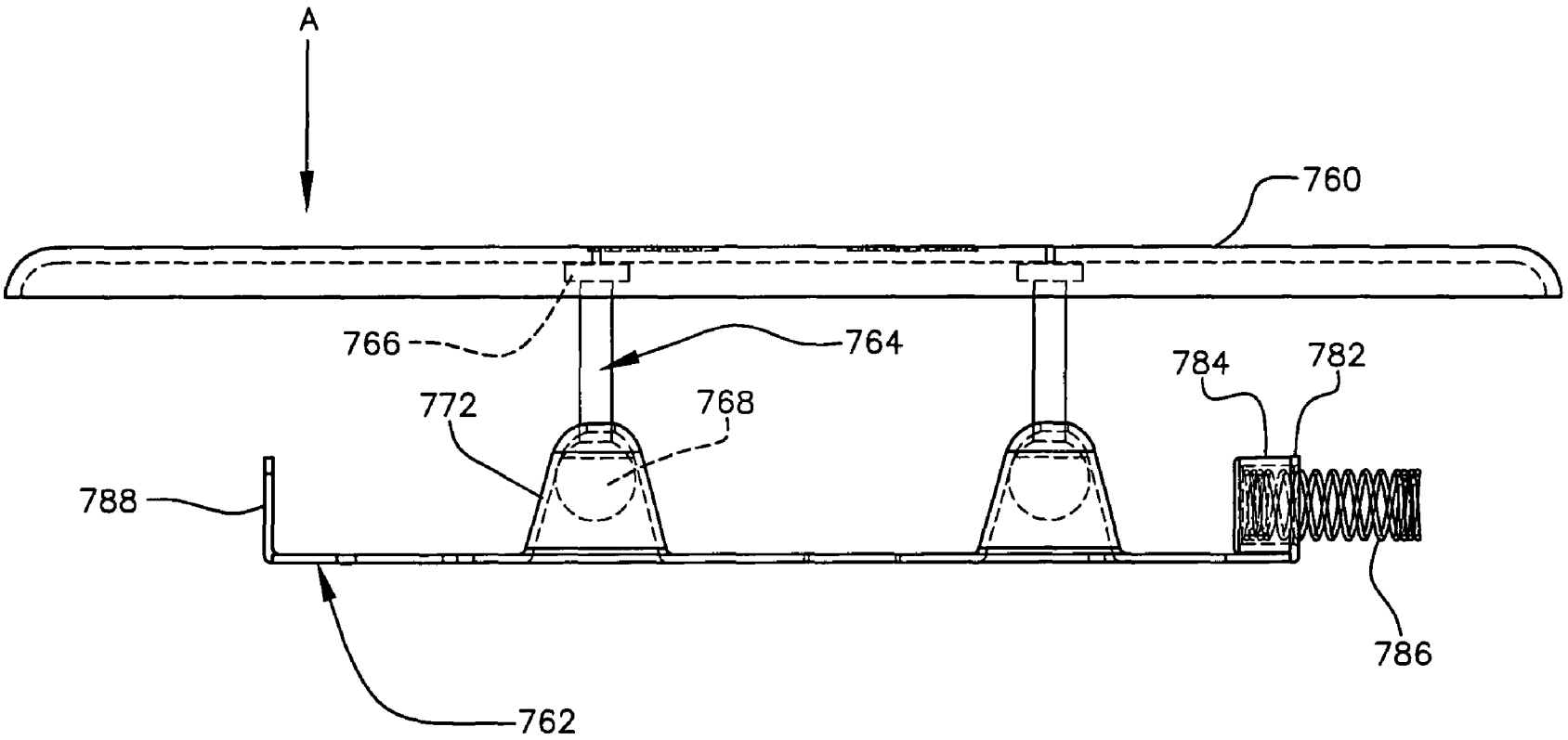
FIG. 44 is a side view of the assembly shown in FIG. 42.

With reference to FIG. 44, each socket 772 is conical in shape having a concave upper inner surface for receiving the ball 768 when the push plate 760 is biased away from the retaining plate 762. The push plate 760 can be biased by springs or other biasing members in any manner including those described above in the aforementioned embodiments. The conical shape of the sockets 772 allows the push plate 760 to pivot about a line that intersects two balls 768 while two other balls 768 are moved towards the retaining plate 762. For example, as shown in FIG. 44, if one where to press on the push plate 760 at arrow A, the push plate 760 and the studs 764 could rotate about the right-most balls 768 (only one of the balls is visible in this view) while the left-most balls 768 (only one of the balls is visible in this view) would move towards the plate 762. Alternatively, instead of having four sockets and studs, a greater or fewer number of sockets and studs can be used. In such an embodiment, the location of the buttons may have to be rearranged.

With reference back to FIG. 43, a first end wall 782 extends from the retaining plate 762 in the same general direction that the sockets 772 extend from the retaining plate. Spring recesses 784 are formed in the end wall 782 and receive springs 786. A second end wall 788 extends from the retaining plate 762 in the same general direction as the first end wall 782. The springs 786 bias against an internal wall of a push plate assembly housing or an internal wall connected to the push plate assembly housing, such as the housings described in the embodiments above. The springs 786, or other biasing members, bias the plate downward so that the balls 768 are seated in the sockets 772 when the push plate 760 is biased from the retaining plate 762 as shown in FIG. 44. To remove the push plate 760 from the retaining plate 762, the push plate 760 is pressed towards the retaining plate 762 so that the balls 768 are disposed behind or underneath the retaining plate 762. A force is then exerted on the lower end wall 788 in a direction opposite the biasing force of the springs 786 so that the studs 764 travel through the slots 778 in the socket 772 and the slots 776 in the retaining plate 762 towards the circular ball opening 774. The push plate 760 can then be pulled away from the retaining plate 762 and the balls 768 pass through the circular openings 774.

In addition to being used with the push plate assemblies described above, the push plate 760 and the retaining plate 762 can also be installed in other known push plate assemblies that are used to operate an automative door, and the like. As seen in FIG. 43, the retaining plate includes a large central opening 792 through which buttons, similar to the buttons described above, can extend. These buttons can selectively contact a signal generator that is in electrical communication directly by a wire with a receiver to activate a door opener or similar activating device or that is in electrical communication with an RF transmitter to wirelessly activate a door opener, or similar actuating device.

Multiple push plate assemblies have been described with reference to preferred embodiments and portions and components of one embodiment can be incorporated into the other embodiments. For example, each of the push plate assemblies that have been described above can activate at least one of an automative door opener, an automative door lock and a door/fire alarm. Removal of the face plate does not require removal of fasteners that extend through or on the front surface, i.e. the surface that is contacted by one who depresses the push plate. Accordingly, the manner in which the push plate is mounted in and/or to the assembly is obfuscated making the assembly more tamper resistant. Furthermore, the fasteners used to attach the push plate in known assemblies can rust when the assembly is mounted outside. Modifications and alterations will occur to other upon reading and understanding the preceding detailed description. It is intended that the invention include all such modifications and alterations that come within the scope of the appended claims or the equivalents thereof.

The invention claimed is:

1. A push plate assembly for operating at least one of an automative door opener, an automative door lock and a door/fire alarm, the assembly comprising:

a housing portion comprising a first latch element;

a mounting member adapted to mount to a wall or other structure and comprising a second latch element, wherein the first and second latch elements cooperate to selectively secure the housing portion to the mounting member;

a push plate movably mounted to the housing portion; and a signal generator adapted to communicate with a receiver of at least one of an associated automative door opener, an associated automative door lock and an associated door/fire alarm, the signal generator connected to the housing with respect to the push plate such that the push plate selectively moves to selectively activate the signal generator when a force is exerted on the push plate.

2. The assembly of claim 1, wherein the mounting member comprises a plate, the second latch element comprises a resilient clip extending from the plate toward the housing portion, and the housing portion includes an opening dimensioned to receive the resilient clip, wherein the housing portion is secured to the mounting member by pressing the housing portion towards the mounting member.

3. The assembly of claim 1, wherein the mounting member comprises a plate, the second element comprises a resilient clip extending from the plate in a direction generally parallel to the push plate, the housing portion includes a notch dimensioned to receive the resilient clip, wherein the housing portion is secured to the mounting member by sliding the housing portion with respect to the mounting member.

4. The assembly of claim 1, wherein the mounting member comprises a plate, the second latch element comprises a locking member connected to, parallel to and spaced from the plate, and the housing portion includes a keyed slot dimensioned to receive the locking member, wherein the housing portion is secured to the mounting member by sliding the housing portion with respect to the mounting member.

5. The assembly of claim 1, further comprising an internal housing connected to the housing and extending away from the push plate, wherein the internal housing is dimensioned to be received inside an associated gange box and the internal housing receives the signal generator.

6. The assembly of claim 5, further comprising a push pad connected to and covering the internal housing, and a plurality of buttons extending from the push pad towards the push plate.

7. A push plate assembly for operating at least one of an automative door opener, an automative door lock and a door/fire alarm, the assembly comprising:

an assembly housing comprising a non-metallic side wall;

a push plate movably mounted in the assembly housing;

a signal generator disposed in the assembly housing;

a biasing member disposed between the push plate and the signal generator, wherein the biasing member biases the push plate away from the signal generator; and an antenna holder disposed in or adjacent the side wall of the assembly housing, wherein the antenna holder is adapted to retain an associated antenna near or spaced externally from a peripheral edge of the push plate.

8. The assembly of claim 7, wherein the side wall of the assembly housing comprises a resilient material that is adapted to conform to an associated surface that the side wall contacts when a force is applied to the side wall in a direction toward the associated surface.

9. The assembly of claim 7, further comprising a signal generator housing connected to the assembly housing and dimensioned to receive the signal generator, the signal generator housing extends away from the push plate and is adapted to be received inside a conventional electrical gange box.

10. A push plate assembly for operating at least one of an automative door opener, an automative door lock and a door/fire alarm, the assembly comprising:

a housing;

a switch disposed in the housing;

circuitry in communication with the switch, a wireless transmitter in communication with the circuitry for allowing communication with an associated receiver of at least one of an associated automative door opener, an associated automative door lock and an associated door/fire alarm;

a push plate movably mounted to the housing, the push plate selectively activating the switch when a force is applied to the push plate moving the push plate towards the switch;

a first latch element connected to the push plate; and a second latch element disposed in the housing, the second latch element selectively engaging the first latch element, wherein at least one of the first latch element and the second latch element is accessible from outside of the housing by an associated hand tool such that the associated hand tool can contact at least one of the first latch element and the second latch element to disengage the first latch element from the second latch element so that the push plate can be selectively removed from the housing.

11. The assembly of claim 10, further comprising a resilient stand-off contacting the housing and the push plate.

12. The assembly of claim 11, wherein the resilient stand-off biases the push plate away from the switch.

13. The assembly of claim 10, wherein the housing comprises a side wall having an opening that is positioned with respect to at least one of the first latch element and the second latch element to provide access to at least one of the first latch element and the second latch element from outside of the housing via the opening.

14. The assembly of claim 13, wherein the first latch element comprises a tab that extends from the push plate into the housing, the tab includes a strike surface, and the second latch element comprises a biased latch that is adapted to selectively engage the strike surface, the second latch element being biased toward the tab.

15. The assembly of claim 14, wherein the biased latch is spaced from the opening such that the biased tab does not extend through the opening.

16. The assembly of claim 10, wherein the housing includes an internal wall to define a compartment, wherein the switch is received in the compartment and the assembly further comprises pad comprising a waterproof material covering the compartment and the switch.

17. The assembly of claim 10, further comprising a mounting plate adapted to mount to a wall or other structure, the housing and the mounting plate being configured such that the housing releasably attaches to the mounting plate.

18. The assembly of claim 17, wherein the mounting plate includes a resilient member that selectively engages a portion of the housing.

19. The assembly of claim 17, wherein the mounting plate includes a member that is selectively received inside a slot in the housing.

20. The assembly of claim 10, further comprising a plurality of switches each in communication with the circuitry, whereby the activation of any of the plurality of switches results in communication with the receiver.

21. A push plate assembly that provides a signal to an associated device, the assembly comprising:

a housing;

a switch disposed in the housing;

a signal generator operatively connected to the switch such that the signal generator generates a signal in response to an operation of the switch, said signal being transmitted to the associated device; and, a push plate that is mounted to the housing so as to selectively operate the switch via a manual movement of the push plate.

22. The assembly of claim 7, wherein the push plate is removably mounted to the housing via a cooperating pair of members including a first member and a second member that are selectively engagable with one another such that when the first and second members are engaged with one another the push plate is secured to the housing.

23. The assembly of claim 22, wherein the second member engages with the first member by extending therethrough.

24. The assembly of claim 22, wherein the first member is connected to the push plate, and the second member is disposed in the housing so as to be movable between a first position in which the first and second members engage with one another and a second position in which the first and second members disengage from one another.

25. The assembly of claim 24, further comprising:

a biasing member that biases the second member to toward the first position.

26. The assembly of claim 24, further comprising:

an opening in the housing through which the second member is accessible for manual movement thereof.

27. The assembly of claim 26, wherein the second member is recessed within the housing away from the opening so as to not extend into the opening.

28. The assembly of claim 10, further comprising:

a biasing member that biases the push plate away from the switch.

29. The assembly of claim 7, wherein the signal generator comprises:

a wireless transmitter that wirelessly transmits the signal to a receiver of the associated device.

30. The assembly of claim 7, further comprising:

a mounting plate adapted to mount to a surface, said housing being removably attachable to said mounting plate.

31. The assembly of claim 30, wherein the housing includes a slot that is selectively engaged with a first member formed on the mounting plate to secure the housing to the mounting plate.

32. The assembly of claim 30, wherein detaching the housing from the mounting plate includes manually sliding the housing relative to the mounting plate.

33. The assembly of claim 32, wherein the mounting plate includes a resilient tab having a potion thereof which is received in an opening formed in the housing when the housing is attached to the mounting plate so as to inhibit the housing from sliding relative to the mounting plate for detachment therefrom.

34. The assembly of claim 21, wherein the associated device is selected from an automative door opener, an automative door lock, a fire alarm or a door alarm.

35. An apparatus for providing a signal to an associated device, the apparatus comprising:

signaling means for generating a signal to be transmitted to the associated device in response to activation of the signaling means;

activating means for activating the signal means in response to operation of the activating means;

housing means for housing the signaling means and the activating means;

operating means for manually operating the activating means, said operating means being removably held by the housing means; and, mounting means for mounting the apparatus to a surface, said housing means being removably secured to the mounting means.

36. The assembly of claim 10, further comprising:

an elastic gasket member arranged between the push plate and the switch.

* * * * *